US011008188B2

(12) United States Patent
Morikawa

(10) Patent No.: US 11,008,188 B2
(45) Date of Patent: May 18, 2021

(54) MEDIUM CONVEYING APPARATUS

(71) Applicant: PFU Limited, Ishikawa (JP)

(72) Inventor: Shuichi Morikawa, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 78 days.

(21) Appl. No.: 16/416,928

(22) Filed: May 20, 2019

(65) Prior Publication Data

US 2019/0270604 A1 Sep. 5, 2019

Related U.S. Application Data

(63) Continuation of application No. PCT/JP2016/087852, filed on Dec. 19, 2016.

(51) Int. Cl.
*B65H 5/36* (2006.01)
*B65H 5/06* (2006.01)

(52) U.S. Cl.
CPC ..... *B65H 5/36* (2013.01); *B65H 5/06* (2013.01); *B65H 5/062* (2013.01); *B65H 5/068* (2013.01); *B65H 2404/144* (2013.01); *B65H 2404/152* (2013.01); *B65H 2404/6111* (2013.01); *B65H 2801/06* (2013.01)

(58) Field of Classification Search
CPC ..... B65H 5/36; B65H 2404/144; B65H 2404/1441; B65H 2404/1442; B65H 2404/152; B65H 2404/1521; B65H 2404/7414; B65H 2701/1125; B65H 2801/06; B65H 2404/6111; B65H 5/068; H04N 1/00615
See application file for complete search history.

(56) References Cited

U.S. PATENT DOCUMENTS 5,205,551 A 4/1993 Nagano et al.
8,172,214 B2 * 5/2012 Kubota ..... G03G 15/6552 270/58.1

(Continued)

FOREIGN PATENT DOCUMENTS

JP 02-282158 A 11/1990
JP 09-208079 A 8/1997

(Continued)

OTHER PUBLICATIONS

International Search Report issued in corresponding International Patent Application No. PCT/JP2016/087852, dated Feb. 7, 2017, with English Translation.

*Primary Examiner* — Jeremy R Severson
(74) *Attorney, Agent, or Firm* — McDermott Will & Emery LLP

(57) ABSTRACT

A medium conveying apparatus includes a conveyance guide that is supported by a frame so as to be able to be lifted and lowered, and guides a medium to a conveyance path by sliding along one surface of the medium, a conveyance roller that is rotatably supported by the frame, and conveys the medium by coming into contact with an other surface of the medium, the other surface being on the reverse side of the one surface, and a pinch roller that is supported by the frame so as to be able to be lifted and lowered, and presses the medium against the conveyance roller by coming into contact with the one surface of the medium, wherein the conveyance guide lifts or lowers the pinch roller relatively to the frame, by being lifted or lowered relatively to the frame.

7 Claims, 15 Drawing Sheets

(56) References Cited

U.S. PATENT DOCUMENTS

| | | | |
|---|---|---|---|
| 2004/0262837 | A1 | 12/2004 | Hamada et al. |
| 2005/0017445 | A1 | 1/2005 | Funaki |
| 2005/0254103 | A1 | 11/2005 | Sugiyama et al. |
| 2010/0254734 | A1 | 10/2010 | Ishioka |

FOREIGN PATENT DOCUMENTS

| | | | |
|---|---|---|---|
| JP | 11-165904 | A | 6/1999 |
| JP | 2005-001827 | A | 1/2005 |
| JP | 2005-029281 | A | 2/2005 |
| JP | 2005-328216 | A | 11/2005 |
| JP | 2007-258964 | A | 10/2007 |
| JP | 2010-241530 | A | 10/2010 |
| JP | 2012-080170 | A | 4/2012 |

* cited by examiner

MEDIUM CONVEYING APPARATUS

CROSS-REFERENCE TO RELATED APPLICATION

This application is a continuation of International Application No. PCT/JP2016/087852, filed on Dec. 19, 2016, the entire contents of which are incorporated herein by reference.

FIELD

The present disclosure relates to a medium conveying apparatus.

BACKGROUND

An image reading apparatus, which conveys a medium by causing the medium to make a U-turn, has been known. The installation space for this image reading apparatus is able to be reduced by: provision of a medium stand at the rear of the image reading apparatus, the medium stand being where a medium to be fed is placed; and provision of a stacker above and in front of the medium stand, the stacker being where a medium that is ejected from the image reading apparatus is placed. This image reading apparatus further has a straight path where a medium is conveyed without being bent, and enables paths to be switched between each other such that when a thick medium is conveyed, the thick medium is conveyed onto the straight path. A medium conveying apparatus, which is able to appropriately convey both a thin medium and a thick medium, has been known (see Japanese Laid-open Patent Publication No. 2007-258964, Japanese Laid-open Patent Publication No. 2005-328216, and Japanese Laid-open Patent Publication No. 09-208079).

However, this medium conveying apparatus has a problem of being large in size because the diameters of its conveyance rolls need to be increased for a thick medium to be conveyed appropriately.

SUMMARY

According to an aspect of an embodiment, a medium conveying apparatus includes a conveyance guide that is supported by a frame so as to be able to be lifted and lowered, and guides a medium to a conveyance path by sliding along one surface of the medium, a conveyance roller that is rotatably supported by the frame, and conveys the medium by coming into contact with an other surface of the medium, the other surface being on the reverse side of the one surface, and a pinch roller that is supported by the frame so as to be able to be lifted and lowered, and presses the medium against the conveyance roller by coming into contact with the one surface of the medium, wherein the conveyance guide lifts or lowers the pinch roller relatively to the frame, by being lifted or lowered relatively to the frame.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure will be explained with reference to accompanying drawings. Described hereinafter by reference to the drawings is a medium conveying apparatus according to an embodiment disclosed by this patent application. The present disclosure is not limited through the following description. Furthermore, each component will be assigned with the same reference sign throughout the description, and redundant explanation thereof will be omitted.

First Embodiment

Figure 1:
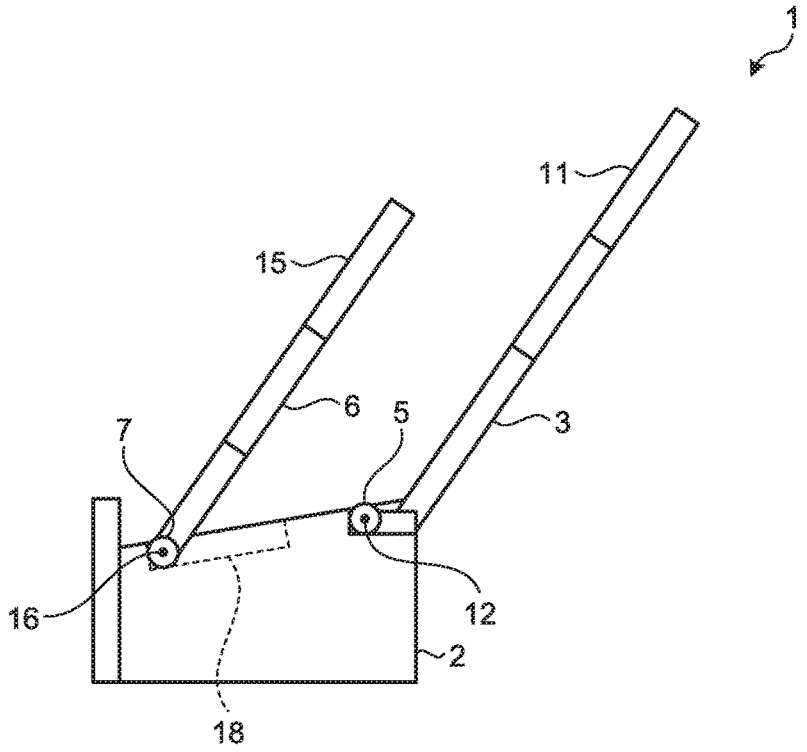
FIG. 1 is a side view illustrating a medium conveying apparatus according to a first embodiment.

FIG. 1 is a side view illustrating a medium conveying apparatus 1 according to a first embodiment. The medium conveying apparatus 1 is used as an image reading apparatus, and includes, as illustrated in FIG. 1, a housing 2, a shooter 3, a shooter supporting unit 5, a stacker 6, and a stacker supporting unit 7. The housing 2 is formed in a box shape, and is placed on an installation surface where the medium conveying apparatus 1 is installed. The shooter 3 is formed in a plate shape, and has a shooter placement surface 11 formed thereon, the shooter placement surface 11 being substantially flat. The shooter 3 is arranged above the housing 2 at a back side (right side in FIG. 1) of the housing 2, such that: the shooter placement surface 11 faces diagonally upward when the installation surface for the medium conveying apparatus 1 is horizontal; and the angle formed between the shooter placement surface 11 and the installation surface for the medium conveying apparatus 1 equals 55 degrees. The shooter supporting unit 5 supports the shooter 3, such that the shooter 3 is able to rotate about a rotation axis 12, relatively to the housing 2. The rotation axis 12 is parallel to the installation surface for the medium conveying apparatus 1, and is also parallel to the shooter placement surface 11. Furthermore, the shooter supporting unit 5 restrains the shooter 3 from rotating, such that the angle formed between the shooter placement surface 11 and the installation surface for the medium conveying apparatus 1 does not become less than 55 degrees. That is, the shooter supporting unit 5 supports the shooter 3, such that the shooter 3 does not rotate clockwise about the rotation axis 12 due to the gravity from the state illustrated in FIG. 1.

The stacker 6 is formed in a plate shape, and has a stacker placement surface 15 formed thereon, the stacker placement surface 15 being substantially flat. The stacker 6 is arranged above the housing 2 at a front side (left side in FIG. 1) of the housing 2, such that the stacker placement surface 15 is substantially parallel to the shooter placement surface 11. That is, the stacker 6 is arranged, such that: the stacker placement surface 15 faces diagonally upward; and the angle formed between the stacker placement surface 15 and the installation surface for the medium conveying apparatus 1 equals 55 degrees. By being arranged as described above, the stacker 6 covers a part of the shooter placement surface 11. The stacker supporting unit 7 supports the stacker 6, such that the stacker 6 is able to rotate about a rotation axis 16, relatively to the housing 2. The rotation axis 16 is parallel to the rotation axis 12, that is, parallel to the installation surface for the medium conveying apparatus 1, and is also parallel to the stacker placement surface 15. The stacker supporting unit 7 also restrains the stacker 6 from rotating, such that the angle formed between the stacker placement surface 15 and the installation surface for the medium conveying apparatus 1 does not become larger than 55 degrees. That is, the stacker supporting unit 7 supports the stacker 6, such that the stacker 6 does not rotate anticlockwise about the rotation axis 16 from the state illustrated in FIG. 1.

The medium conveying apparatus 1 has a stacker storage region 18, formed therein. The stacker storage region 18 is formed in an upper portion of the housing 2, the upper portion being between the shooter 3 and the stacker 6. That is, the stacker storage region 18 is located in the upper portion of the housing 2, the upper portion being more backward than the rotation axis 16 of the stacker 6 and being more forward than the rotation axis 12 of the shooter 3.

Figure 2:
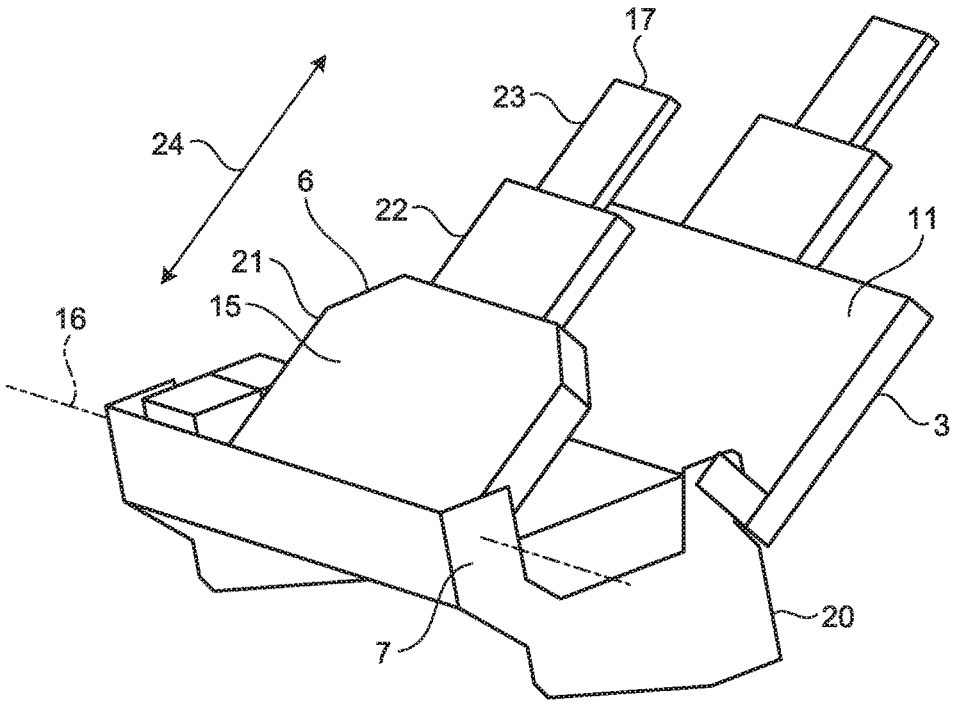
FIG. 2 is a perspective view illustrating a stacker and a shooter.

FIG. 2 is a perspective view illustrating the stacker 6 and the shooter 3. The medium conveying apparatus 1 further includes, as illustrated in FIG. 2, a frame 20. The frame 20 is arranged inside the housing 2, and fixed to the housing 2. The stacker 6 includes a first stacker member 21, a second stacker member 22, and a third stacker member 23. The first stacker member 21 is formed in a plate shape, and forms a part of the stacker placement surface 15. The first stacker member 21 is supported by the stacker supporting unit 7 on the frame 20, so as to be rotatable about the rotation axis 16. The second stacker member 22 is formed in a plate shape thinner than that of the first stacker member 21, and forms a part of the stacker placement surface 15. The second stacker member 22 is supported by the first stacker member 21, so as to be movable parallelly to an expansion and contraction direction 24, such that the second stacker member 22 is able to be pulled out from the interior of the first stacker member 21 and pushed into the interior of the first stacker member 21. The expansion and contraction direction 24 is perpendicular to the rotation axis 16 and parallel to the stacker placement surface 15. The third stacker member 23 is formed in a plate shape thinner than that of the second stacker member 22, and forms a part of the stacker placement surface 15. The third stacker member 23 is supported by the second stacker member 22, so as to be movable parallelly to the expansion and contraction direction 24, such that the third stacker member 23 is able to be pulled out from the interior of the second stacker member 22 and pushed into the interior of the second stacker member 22. By being formed as described above, the stacker 6 is expandably and contractably formed to: contract such that an end portion 17 of the stacker 6 approaches the rotation axis 16, the end portion 17 being at a side far from the rotation axis 16; and expand such that the end portion 17 moves away from the rotation axis 16.

The stacker 6 further includes an interlocking mechanism not illustrated in the drawings. The interlocking mechanism converts a motion of the second stacker member 22 being pulled out from the first stacker member 21 or being pushed into the first stacker member 21, into a motion of the third stacker member 23 being pulled out from the second stacker member 22 or being pushed into the second stacker member 22. That is, the interlocking mechanism mechanically converts the motion of the second stacker member 22 being pulled out from the first stacker member 21, into a motion of the third stacker member 23 being pulled out from the second stacker member 22. Furthermore, the interlocking mechanism mechanically converts the motion of the second stacker member 22 being pushed into the first stacker member 21, into a motion of the third stacker member 23 being pushed into the second stacker member 22. Because the stacker 6 includes the interlocking mechanism described above, the stacker 6 expands and contracts by the second stacker member 22 being pulled out from the first stacker member 21 and being pushed into the first stacker member 21.

Figure 3:
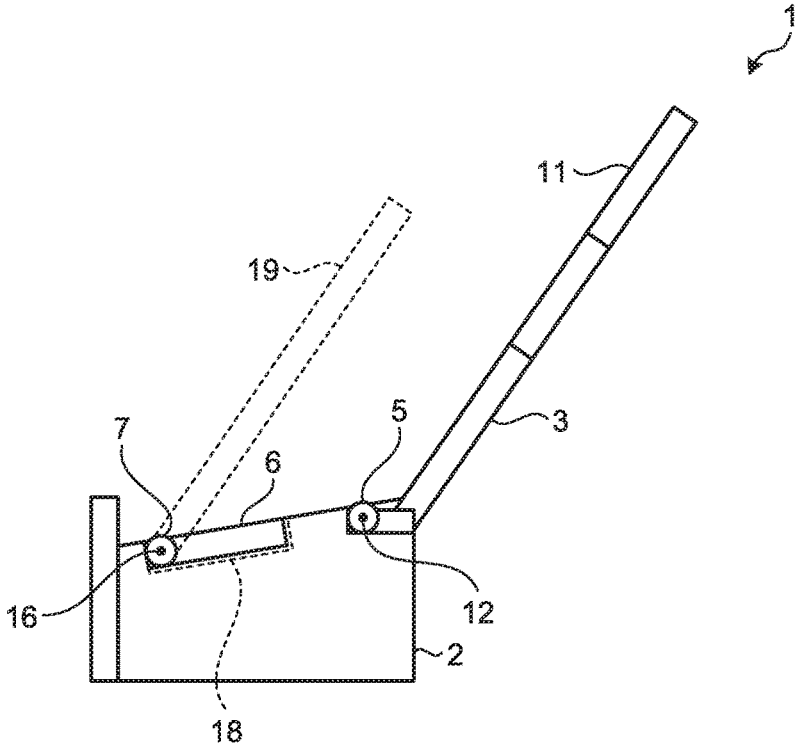
FIG. 3 is a side view illustrating the medium conveying apparatus when the stacker has been stored.

FIG. 3 is a side view illustrating the medium conveying apparatus 1 when the stacker 6 has been stored in the stacker storage region 18. When the stacker 6 is shortened, as illustrated in FIG. 3, by rotating about the rotation axis 16, the stacker 6 is placed and stored into the stacker storage region 18. That is, the stacker supporting unit 7 supports the stacker 6 movably, such that the stacker 6 is placed in the stacker storage region 18 or a stacker expansion region 19. The stacker expansion region 19 is a region where the stacker 6 is placed in FIG. 1. That is, by the stacker 6 being placed in the stacker expansion region 19, the stacker placement surface faces diagonally upward and the angle formed between the stacker placement surface 15 and the installation surface for the medium conveying apparatus 1 substantially equals 55 degrees.

By the stacker 6 being placed in the stacker storage region 18: the shooter placement surface 11 is exposed; and an area of a region of the shooter placement surface 11 is able to be reduced as compared to when the stacker 6 is placed in the stacker expansion region 19, the region being covered by the stacker 6. That is, an area of a figure that is an orthographic projection of the stacker 6 placed in the stacker storage region 18 on the shooter placement surface 11 is smaller than an area of a figure that is an orthographic projection of the stacker 6 placed in the stacker expansion region 19 on the shooter placement surface 11.

Figure 4:
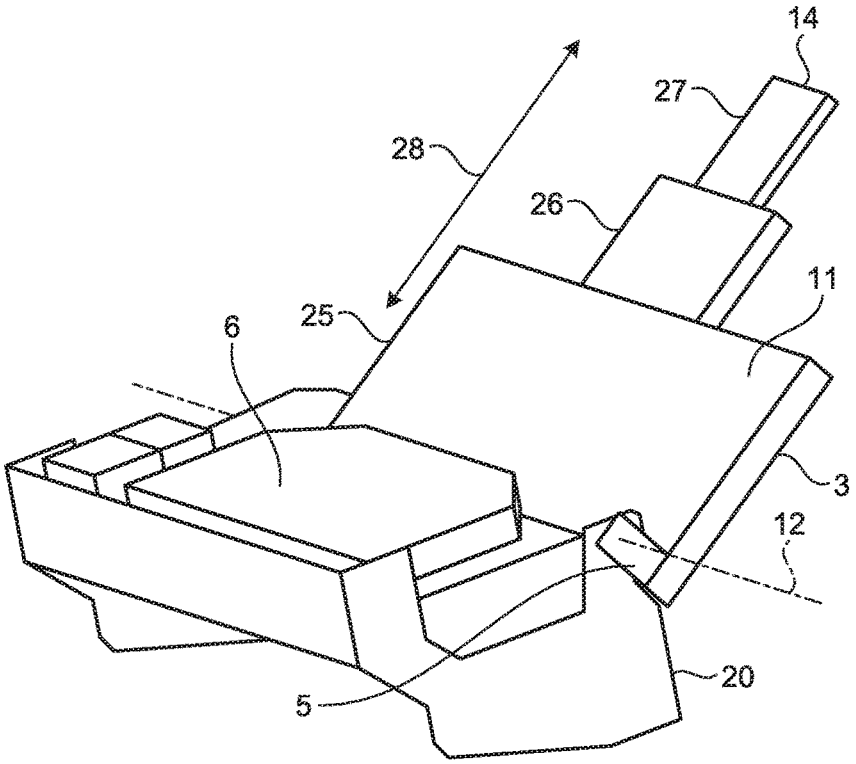
FIG. 4 is a perspective view illustrating the stacker and the shooter when the stacker has been stored.

FIG. 4 is a perspective view illustrating the stacker 6 and the shooter 3 when the stacker 6 has been stored in the stacker storage region 18. As illustrated in FIG. 4, the shooter 3 includes a first shooter member 25, a second shooter member 26, and a third shooter member 27. The first shooter member 25 is formed in a plate shape, and forms a part of the shooter placement surface 11. The first shooter member 25 is supported by the shooter supporting unit 5 on the frame 20, so as to be rotatable about the rotation axis 12. The second shooter member 26 is formed in a plate shape that is thinner than that of the first shooter member 25, and forms a part of the shooter placement surface 11. The second shooter member 26 is supported by the first shooter member 25, so as to be movable parallelly to an expansion and contraction direction 28, such that the second shooter member 26 is able to be pulled out from the interior of the first shooter member 25 and pushed into the interior of the first shooter member 25. The expansion and contraction direction 28 is perpendicular to the rotation axis 12, and parallel to the shooter placement surface 11. The third shooter member 27 is formed in a plate shape thinner than that of the second shooter member 26, and forms a part of the shooter placement surface 11. The third shooter member 27 is supported by the second shooter member 26, so as to be movable parallelly to the expansion and contraction direction 28, such that the third shooter member 27 is able to be pulled out from the interior of the second shooter member 26 and pushed into the interior of the second shooter member 26. By being formed as described above, the shooter 3 is expandably and contractably formed to: contract such that an end portion 14 of the shooter 3 approaches the rotation axis 12, the end portion 14 being at a side far from the rotation axis 12; and expand such that the end portion 14 moves away from the rotation axis 12.

Figure 5:
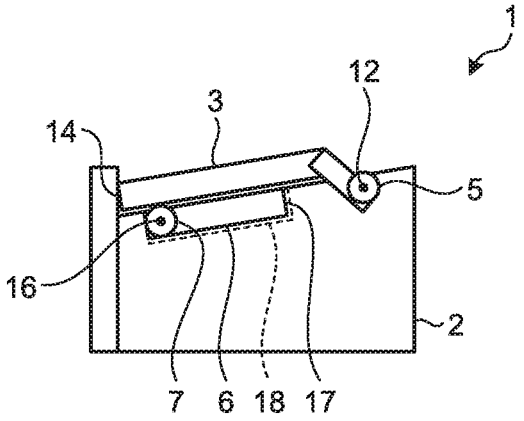
FIG. 5 is a side view illustrating the medium conveying apparatus when the shooter has been stored.
Figure 6:
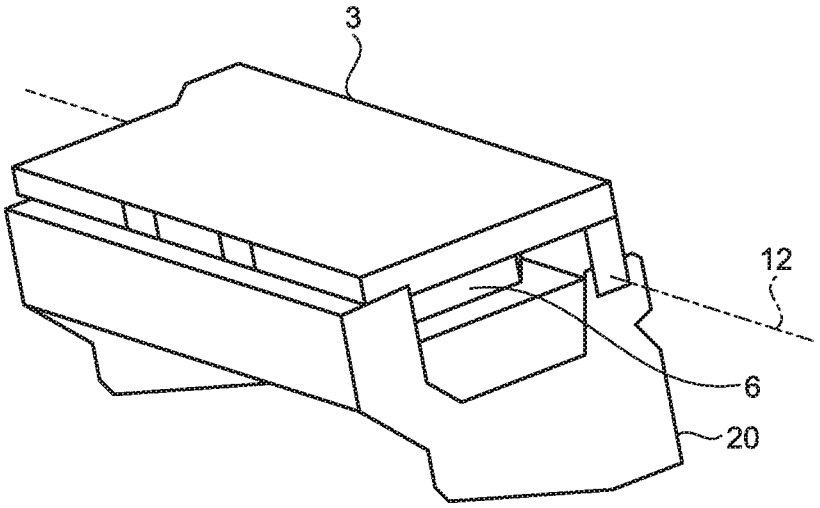
FIG. 6 is a perspective view illustrating the stacker and the shooter when the shooter has been stored.

FIG. 5 is a side view illustrating the medium conveying apparatus 1 when the shooter 3 has been stored. FIG. 6 is a perspective view illustrating the stacker 6 and the shooter 3 when the shooter 3 has been stored. The shooter 3 is able to be placed above the stacker 6, as illustrated in FIG. 5, by rotating about the rotation axis 12, when the stacker 6 has been stored in the stacker storage region 18. The shooter 3 is stored by contracting and being placed above the stacker 6. That is, the shooter supporting unit 5 movably supports the shooter 3 such that: as illustrated in FIG. 3, the shooter 3 is expanded; and as illustrated in FIG. 5, the shooter 3 is stored above the stacker 6. By the shooter 3 being stored, the medium conveying apparatus 1 is reduced in height and thus downsized. Furthermore, by being stored, as illustrated in FIG. 6, the shooter 3 is able to cover the stacker 6.

Figure 7:
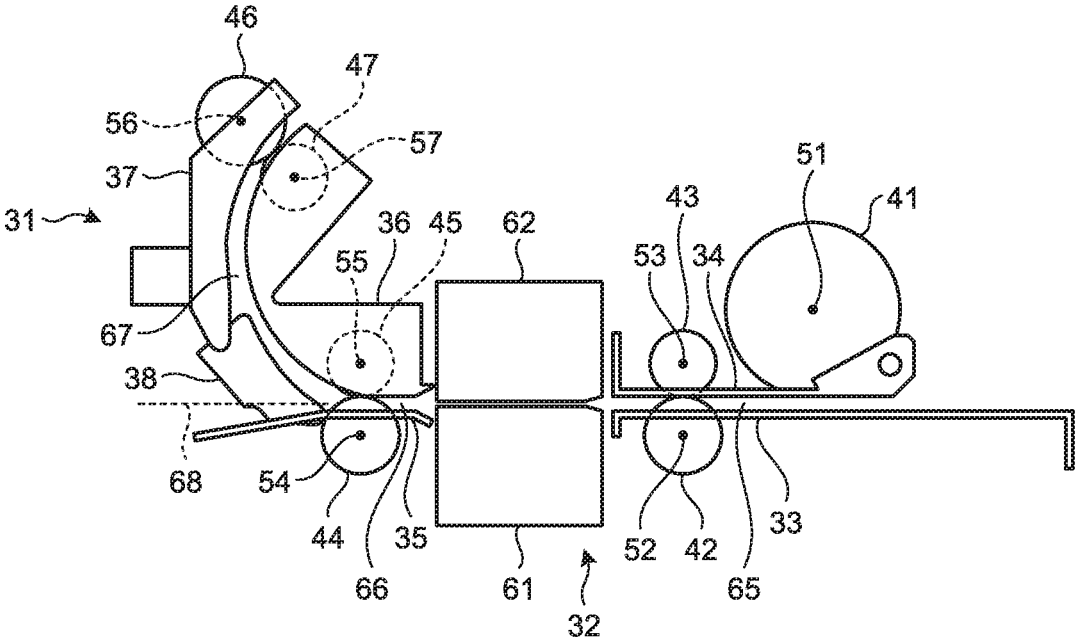
FIG. 7 is a sectional view illustrating a conveyor and a reader.

FIG. 7 is a sectional view illustrating a conveyor 31 and a reader 32. The medium conveying apparatus 1 further includes, as illustrated in FIG. 7, the conveyor 31 and the reader 32.

Conveyor

The conveyor 31 is arranged inside the housing 2. The conveyor 31 includes plural conveyance guides 33 to 37, a switching guide 38, and plural rollers 41 to 47. The plural conveyance guides 33 to 37 include a first conveyance guide 33, a second conveyance guide 34, a third conveyance guide 35, a fourth conveyance guide 36, and a fifth conveyance guide 37. The first conveyance guide 33 is formed in a plate shape that is mostly flat. The first conveyance guide 33 is arranged to be along a plane substantially parallel to the installation surface for the medium conveying apparatus 1, and is fixed to the frame 20. The second conveyance guide 34 is formed in a plate shape that is mostly flat. The second conveyance guide 34 is arranged above the first conveyance guide 33, so as to be opposite to the first conveyance guide 33. Furthermore, the second conveyance guide 34 is supported by the frame 20, so as to be able to be lifted and lowered in a vertical direction.

The third conveyance guide 35 is formed substantially in a plate shape. The third conveyance guide 35 is arranged on a front side of the first conveyance guide 33, so as to be along a plane that the first conveyance guide 33 is along, and is fixed to the frame 20. The fourth conveyance guide 36 is formed in a shape of a column, and has a convex surface formed thereon, the convex surface being along a part of a side surface of the column. The fourth conveyance guide 36 is arranged above the third conveyance guide 35, such that a part of the convex surface is opposite to the third conveyance guide 35. The fourth conveyance guide 36 is fixed to the frame 20. The fifth conveyance guide 37 is formed in a shape of a column, and has a concave surface formed thereon, the concave surface being along a part of a side surface of the column. The fifth conveyance guide 37 is arranged on a front side of the fourth conveyance guide 36, such that its concave surface is opposite to a part of the convex surface of the fourth conveyance guide 36.

By including the plural conveyance guides 33 to 37, the conveyor 31 has a conveyance path 65, a conveyance path 66, a U-turn conveyance path 67, and a straight conveyance path 68, formed therein. The conveyance path 65 is formed between the first conveyance guide 33 and the second conveyance guide 34. The conveyance path 65 is formed to be along a plane parallel to the installation surface for the medium conveying apparatus 1. Furthermore, the conveyance path 65 is formed to be connected to the shooter placement surface 11 when the shooter 3 has been expanded. The conveyance path 66 is formed between the third conveyance guide 35 and the fourth conveyance guide 36. The conveyance path 66 is formed to be along a plane that is along the conveyance path 65.

The U-turn conveyance path 67 is formed between the fourth conveyance guide 36 and the fifth conveyance guide 37. The U-turn conveyance path 67 is formed to be along a side surface of a column. Furthermore, the U-turn conveyance path 67 is formed to be connected to the stacker placement surface 15 when the stacker 6 has been placed in the stacker expansion region 19. The straight conveyance path 68 is formed below the fifth conveyance guide 37. The straight conveyance path 68 is formed to be along a plane that the conveyance path 65 is along. Furthermore, the straight conveyance path 68 is formed to be connected to the exterior of the housing 2.

The switching guide 38 is formed substantially in a plate shape, and is supported movably by the frame 20, so as to be placed at a U-turn path guiding position or a straight path guiding position. The switching guide 38 connects the conveyance path 66 to the U-turn conveyance path 67 by being placed at the U-turn path guiding position. The switching guide 38 connects the conveyance path 66 to the straight conveyance path 68 by being placed at the straight path guiding position.

The plural rollers 41 to 47 include a pick roller 41, a first conveyance roller 42, a pinch roller 43, a second conveyance roller 44, a third conveyance roller 45, a fourth conveyance roller 46, and a fifth conveyance roller 47. The pick roller 41 is formed in a cylindrical shape, and is arranged above the conveyance path 65. The pick roller 41 is supported by the frame 20, rotatably about a rotation axis 51. The rotation axis 51 is parallel to the rotation axis 12. Furthermore, the pick roller 41 is arranged to come into contact with a medium placed on the shooter placement surface 11 of the shooter 3 that has been expanded. By the pick roller 41 rotating normally (clockwise in FIG. 7) about the rotation axis 51, one of plural media that have been placed on the shooter placement surface 11 is conveyed onto the conveyance path 65, the one being a medium that is in contact with the pick roller 41.

The first conveyance roller 42 is formed in a cylindrical shape, and is arranged below the conveyance path 65 and more forward than the pick roller 41. The first conveyance roller 42 is supported by the frame 20, rotatably about a rotation axis 52. The rotation axis 52 is parallel to the rotation axis 51. The pinch roller 43 is formed in a cylindrical shape, and arranged above the first conveyance roller 42. The pinch roller 43 is supported by the frame 20, rotatably about a rotation axis 53, and so as to be able to be lifted and lowered in the vertical direction. The rotation axis 53 is parallel to the rotation axis 52. Furthermore, the first conveyance roller 42 and the pinch roller 43 are arranged, such that a medium conveyed on the conveyance path 65 is sandwiched between the first conveyance roller 42 and the pinch roller 43. The medium conveyed on the conveyance path 65 is conveyed onto the conveyance path 66, by the first conveyance roller 42 normally (anticlockwise in FIG. 7) rotating about the rotation axis 52, and the pinch roller 43 pressing the medium against the first conveyance roller 42. By the medium conveyed on the conveyance path 65 coming into contact with the second conveyance guide 34, the second conveyance guide 34 is lifted or lowered relatively to the frame 20, such that the second conveyance guide 34 is placed at a height corresponding to a thickness of that medium. That is, the thicker the medium conveyed on the conveyance path 65 is, the higher the height where the second conveyance guide 34 is placed becomes. The pinch roller 43 is lifted or lowered to be placed at a height corresponding to the thickness of the medium conveyed on the conveyance path 65. That is, the thicker the medium conveyed on the conveyance path 65 is, the higher the height where the pinch roller 43 is placed becomes.

The second conveyance roller 44 is formed in a cylindrical shape, and is arranged below the conveyance path 66. The second conveyance roller 44 is supported by the frame 20, rotatably about a rotation axis 54. The rotation axis 54 is parallel to the rotation axis 51. The third conveyance roller 45 is formed in a cylindrical shape, and is arranged above the conveyance path 66. The third conveyance roller 45 is supported by the frame 20, rotatably about a rotation axis 55, and so as to be able to be lifted and lowered in the vertical direction. The rotation axis 55 is parallel to the rotation axis 54. Furthermore, the second conveyance roller 44 and the third conveyance roller 45 are arranged, such that a medium conveyed on the conveyance path 66 is sandwiched between the second conveyance roller 44 and the third conveyance roller 45. The third conveyance roller 45 is lifted or lowered to be placed at a height corresponding to a thickness of the medium conveyed on the conveyance path 66. That is, the thicker the medium conveyed on the conveyance path 66 is, the higher the height where the third conveyance roller 45 is placed becomes.

The medium conveyed on the conveyance path 66 is conveyed onto the U-turn conveyance path 67 or the straight conveyance path 68, by the second conveyance roller 44 rotating normally (anticlockwise in FIG. 7) about the rotation axis 54 and the third conveyance roller 45 rotating normally (clockwise in FIG. 7) about the rotation axis 55.

The fourth conveyance roller 46 is formed in a cylindrical shape, and is arranged on a front side of the U-turn conveyance path 67. The fourth conveyance roller 46 is supported by the frame 20, rotatably about a rotation axis 56. The rotation axis 56 is parallel to the rotation axis 51. The fifth conveyance roller 47 is formed in a cylindrical shape, and is arranged on a back side of the fourth conveyance roller 46. The fifth conveyance roller 47 is supported by the frame 20, rotatably about a rotation axis 57. The rotation axis 57 is parallel to the rotation axis 56. The fourth conveyance roller 46 and the fifth conveyance roller 47 are arranged, such that a medium conveyed on the U-turn conveyance path 67 is sandwiched between the fourth conveyance roller 46 and the fifth conveyance roller 47. The medium conveyed on the U-turn conveyance path 67 is placed on the stacker placement surface 15 of the stacker 6 in the stacker expansion region 19, by the fourth conveyance roller 46 rotating normally (anticlockwise in FIG. 7) and the fifth conveyance roller 47 rotating normally (clockwise in FIG. 7).

By being configured as described above, the conveyor 31 conveys a medium placed uppermost in the media placed on the shooter 3, onto the conveyance paths 65 and 66. Furthermore, the conveyor 31 conveys a medium that has been conveyed to the U-turn conveyance path 67 from the conveyance path 66, onto the stacker 6, and places that medium onto the stacker placement surface 15. Upon this placement, a side of the medium, the side facing the shooter placement surface 11 when the medium is placed on the shooter 3, is the reverse side of a side that faces the stacker placement surface 15 when the medium is placed on the stacker placement surface 15 of the stacker 6. Moreover, the conveyor 31 ejects a medium conveyed to the straight conveyance path 68 from the conveyance path 66, to the exterior of the housing 2. The U-turn conveyance path 67 is more bent than the straight conveyance path 68. Therefore, a medium that passes through the U-turn conveyance path 67 is more deformed than a medium that passes through the straight conveyance path 68.

Reader

The reader 32 is arranged inside the housing 2 and between the conveyance path 65 and the conveyance path 66. The reader 32 includes a lower image sensor 61 and an upper image sensor 62. The lower image sensor 61 is arranged on a lower side of a plane that the conveyance path 65 and the conveyance path 66 are along, and is fixed to the frame 20. The lower image sensor 61 is formed of a contact image sensor (CIS) type image sensor. The lower image sensor 61 comes into contact with a lower read surface of a medium conveyed from the conveyance path 65 to the conveyance path 66, illuminates the lower read surface, and receives light reflected from the lower read surface; thereby reading an image of the lower read surface. The upper image sensor 62 is arranged on an upper side of the plane that the conveyance path 65 and the conveyance path 66 are along, and is supported by the frame 20 to be able to move parallelly to the vertical direction. The upper image sensor is formed of a CIS type image sensor. The upper image sensor 62 illuminates an upper read surface of the medium conveyed from the conveyance path 65 to the conveyance path 66, and receives light reflected from the upper read surface; thereby reading an image of the upper read surface.

Guide Suspending Structure

Figure 8:
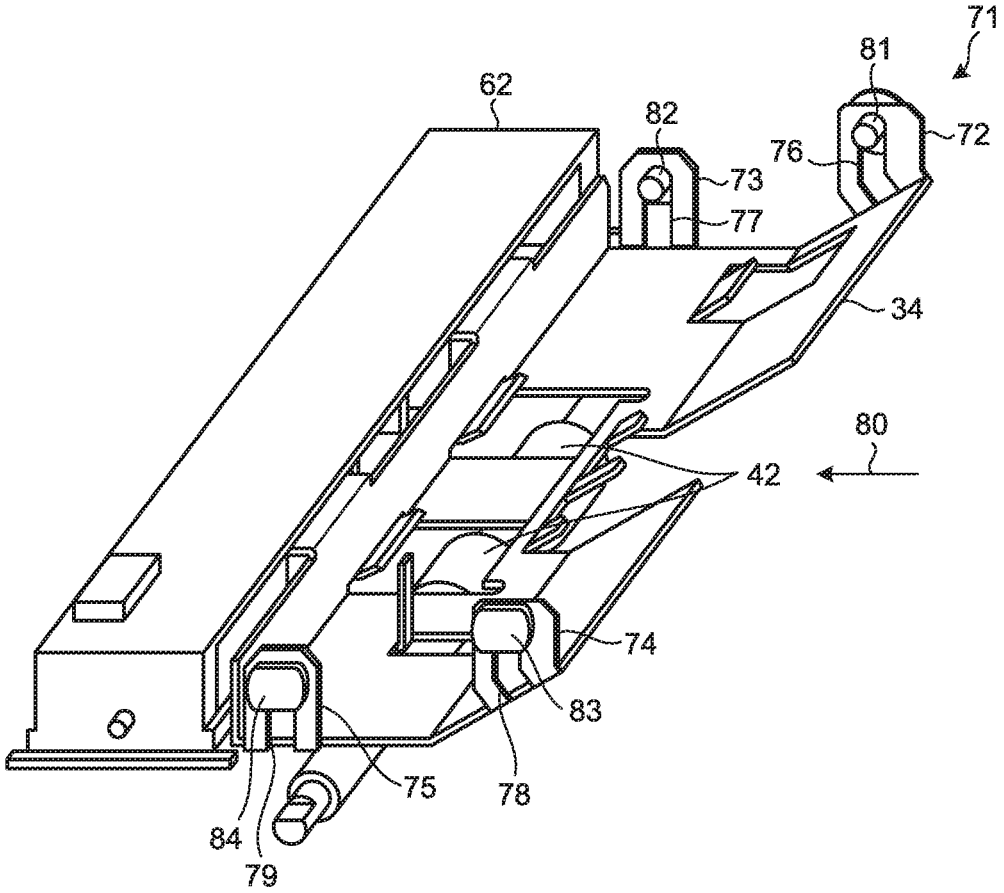
FIG. 8 is a perspective view illustrating a guide suspending structure.

FIG. 8 is a perspective view illustrating a guide suspending structure 71. The medium conveying apparatus 1 further includes, as illustrated in FIG. 8, the guide suspending structure 71. The guide suspending structure 71 includes a right back side supporting member 72, a right front side supporting member 73, a left back side supporting member 74, and a left front side supporting member 75. The right back side supporting member 72, the right front side supporting member 73, the left back side supporting member 74, and the left front side supporting member 75 are each formed in a plate shape. The right back side supporting member 72 and the left back side supporting member 74 are located above the second conveyance guide 34, so as to be opposite to each other across the second conveyance guide 34. The right front side supporting member 73 is located above the second conveyance guide 34, so as to be located on a front side of the right back side supporting member 72 and located in the same plane as the right back side supporting member 72. The plane that the right back side supporting member 72 and the right front side supporting member 73 are along is: perpendicular to a lower surface that comes into contact with a medium conveyed on the conveyance path 65, the lower surface being that of the second conveyance guide 34; and parallel to a conveyance direction 80, along which the medium is conveyed on the conveyance path 65. The left front side supporting member 75 is located above the second conveyance guide 34, so as to be located on a front side of the left back side supporting member 74 and located in the same plane as the left back side supporting member 74. The plane that the left back side supporting member 74 and the left front side supporting member 75 are along is perpendicular to the lower surface of the second conveyance guide 34, and is parallel to the conveyance direction 80, along which the medium is conveyed on the conveyance path 65. The right back side supporting member 72, the right front side supporting member 73, the left back side supporting member 74, and the left front side supporting member 75 are each fixed to the second conveyance guide 34.

The right back side supporting member 72 has a slide groove 76 formed therein. The right front side supporting member 73 has a slide groove 77 formed therein. The left back side supporting member 74 has a slide groove 78 formed therein. The left front side supporting member 75 has a slide groove 79 formed therein.

The guide suspending structure 71 further includes a right back side guide pin 81, a right front side guide pin 82, a left back side guide pin 83, and a left front side guide pin 84. The right back side guide pin 81, the right front side guide pin 82, the left back side guide pin 83, and the left front side guide pin 84 are each formed in a rod shape. The right back side guide pin 81 is arranged to be along a straight line perpendicular to the plane that is along the right back side supporting member 72, is fitted into the slide groove 76, and is fixed to the frame 20. The right front side guide pin 82 is arranged to be along a straight line perpendicular to the plane that is along the right front side supporting member 73, is fitted into the slide groove 77, and is fixed to the frame 20. The left back side guide pin 83 is arranged to be along a straight line perpendicular to the plane that is along the left back side supporting member 74, is fitted into the slide groove 78, and is fixed to the frame 20. The left front side guide pin 84 is arranged to be along a straight line perpendicular to the plane that is along the left front side supporting member 75, is fitted into the slide groove 79, and is fixed to the frame 20.

Figure 9:
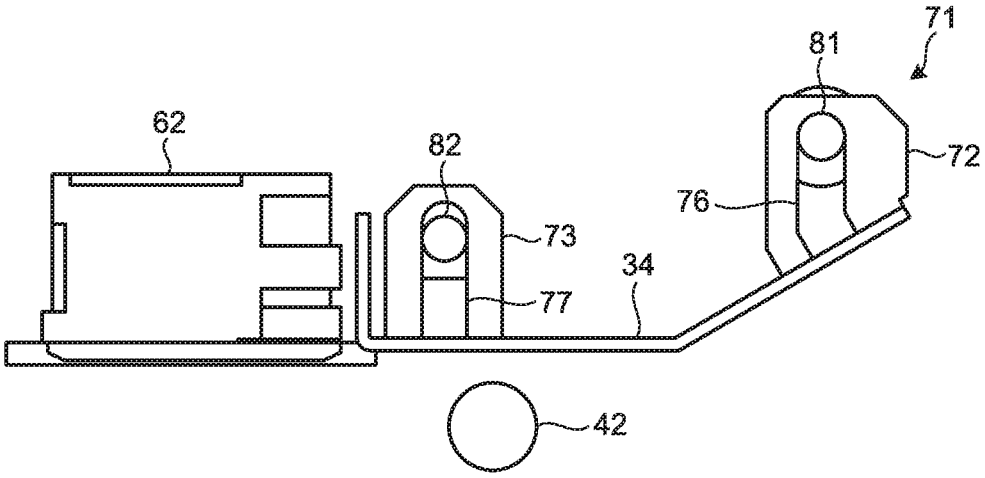
FIG. 9 is a sectional view illustrating the guide suspending structure.

FIG. 9 is a sectional view illustrating the guide suspending structure 71. The slide groove 76 is formed, as illustrated in FIG. 9, to be along a straight line perpendicular to the lower surface of the second conveyance guide 34. The slide groove 77 is formed to be along a straight line perpendicular to the lower surface of the second conveyance guide 34.

Figure 10:
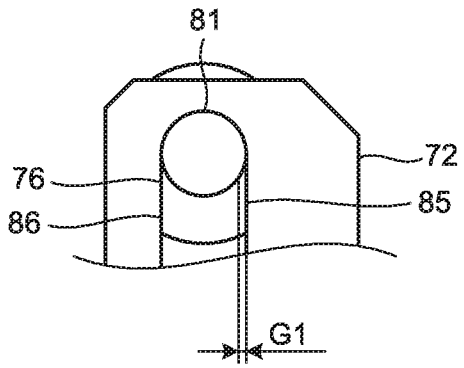
FIG. 10 is a plan view illustrating a slide groove and a right back side guide pin.

FIG. 10 is a plan view illustrating the slide groove 76 and the right back side guide pin 81. The slide groove 76 has, as illustrated in FIG. 10, a back end 85 and a front end 86, formed therein. The back end 85 is formed to be along a straight line perpendicular to the lower surface of the second conveyance guide 34. The front end 86 is opposite to the back end 85, and formed to be along a straight line perpendicular to the lower surface of the second conveyance guide 34. By the slide groove 76 being formed as described above, the right back side guide pin 81 is guided to move along a straight line perpendicular to the lower surface of the second conveyance guide 34.

Furthermore, the slide groove 76 is formed, such that a clearance of a predetermined width G1 is formed between the back end 85 and the right back side guide pin 81, or between the front end 86 and the right back side guide pin 81.

Figure 11:
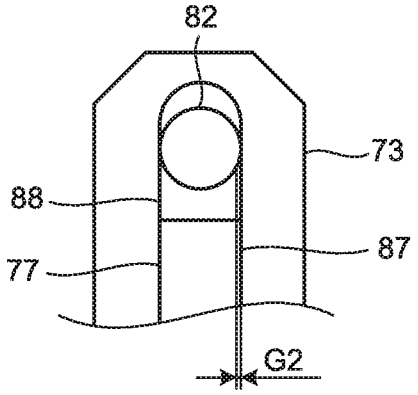
FIG. 11 is a plan view illustrating a slide groove and a right front side guide pin.

FIG. 11 is a plan view illustrating the slide groove 77 and the right front side guide pin 82. The slide groove 77 has, as illustrated in FIG. 11, a back end 87 and a front end 88, formed therein. The back end 87 is formed to be along a straight line perpendicular to the lower surface of the second conveyance guide 34. The front end 88 is formed to be opposite to the back end 87 and along a straight line perpendicular to the lower surface of the second conveyance guide 34. By the slide groove 77 being formed as described above, the right front side guide pin 82 is guided to move along a straight line perpendicular to the lower surface of the second conveyance guide 34.

Furthermore, the slide groove 77 is formed, such that a clearance of a predetermined width G2 is formed between the back end 87 and the right front side guide pin 82, or between the front end 88 and the right front side guide pin 82. The predetermined width G2 is smaller than the predetermined width G1.

Similarly to the slide groove 76, the slide groove 78 guides the left back side guide pin 83, such that the left back side guide pin 83 moves along a straight line perpendicular to the lower surface of the second conveyance guide 34. The slide groove 78 further has the clearance of the predetermined width G1 from the left back side guide pin 83. Similarly to the slide groove 77, the slide groove 79 guides the left front side guide pin 84, such that the left front side guide pin 84 moves along a straight line perpendicular to the lower surface of the second conveyance guide 34. The slide groove 79 further has the clearance of the predetermined width G2 from the left front side guide pin 84.

By the provision of the guide suspending structure 71 described above, the second conveyance guide 34 is able to be lifted and lowered relatively to the frame 20. By the clearances being formed in the guide suspending structure 71, the second conveyance guide 34 is able to be inclined to be along a plane not parallel to an upper surface of the first conveyance guide 33. Furthermore, by the predetermined width G2 being smaller than the predetermined width G1; a backlash at a front side of the second conveyance guide 34 in the conveyance direction is smaller than a backlash at a back side of the second conveyance guide 34 in the conveyance direction, the front side being close to the upper image sensor 62, the back side being far from the upper image sensor 62.

Figure 12:
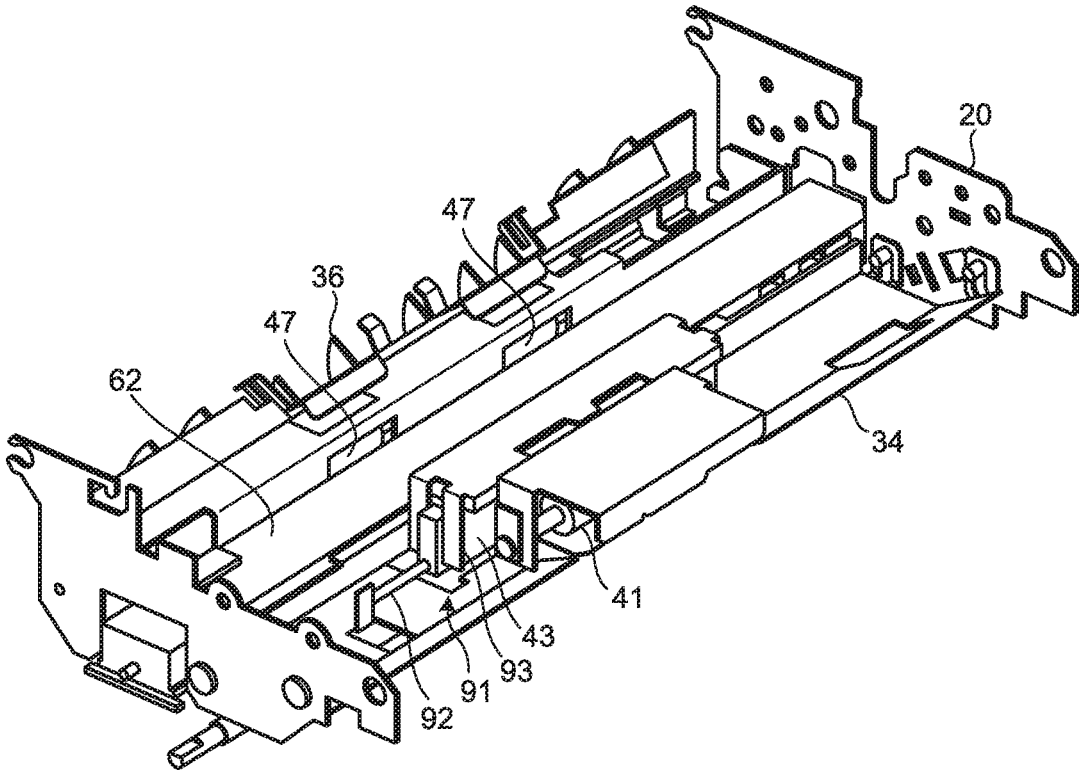
FIG. 12 is a perspective view illustrating a pinch roller support structure.

FIG. 12 is a perspective view illustrating a pinch roller support structure 91. The medium conveying apparatus 1 further includes, as illustrated in FIG. 12, the pinch roller support structure 91. The pinch roller support structure 91 includes a pinch roller shaft 92 and a pinch roller shaft guide 93. The pinch roller shaft 92 is formed in a rod shape. The pinch roller shaft guide 93 is arranged above the second conveyance guide 34, and fixed to the frame 20. The pinch roller shaft guide 93 supports the pinch roller shaft 92, such that the pinch roller shaft 92 is movable in a direction perpendicular to the upper surface of the first conveyance guide 33, the upper surface being a surface that comes into contact with a medium conveyed on the conveyance path 65.

Figure 13:
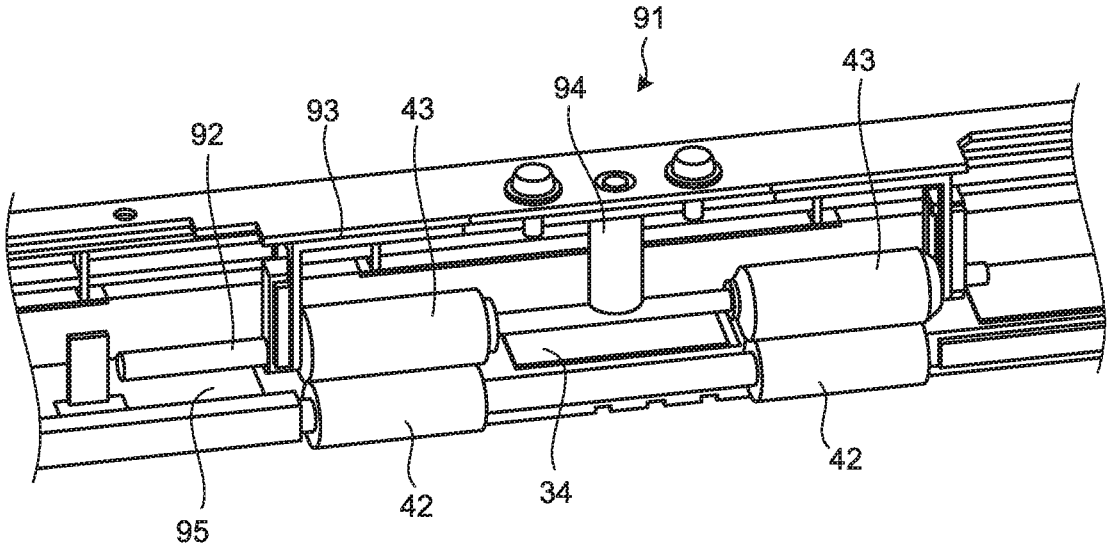
FIG. 13 is a perspective sectional view illustrating the pinch roller support structure.

FIG. 13 is a perspective sectional view illustrating the pinch roller support structure 91. The pinch roller support structure 91 further includes, as illustrated in FIG. 13, a compression coil spring 94 and a pinch roller shaft suspending portion 95. The compression coil spring 94 is formed of an elastic material, and provides elastic force to the pinch roller shaft 92, such that the pinch roller shaft 92 moves downward relatively to the pinch roller shaft guide 93 (that is, the frame 20). The pinch roller shaft suspending portion 95 is formed to be opposite to a lower side of the pinch roller shaft 92, and is fixed to the second conveyance guide 34.

The pinch roller 43 is formed in a cylindrical shape having a cavity formed therein. The pinch roller shaft 92 is inserted in the cavity of pinch roller 43, such that an inner wall of the cavity closely contacts an outer peripheral surface of the pinch roller shaft 92. The pinch roller 43 is rotated, by the inner wall of the cavity sliding along the outer periphery of the pinch roller shaft 92. By the provision of this pinch roller support structure 91, the pinch roller 43 is supported by the frame 20, rotatably about the rotation axis 53, and so as to be able to be lifted and lowered in the vertical direction. By the provision of the pinch roller support structure 91 as described above, the pinch roller shaft suspending portion 95 comes into contact with the lower side of the pinch roller shaft 92 when the second conveyance guide 34 is lifted to a predetermined height. When the second conveyance guide 34 is further lifted in the state where the pinch roller shaft suspending portion 95 is in contact with the pinch roller shaft 92, the second conveyance guide 34 lifts the pinch roller shaft 92 and thereby lifts the pinch roller 43.

Figure 14:
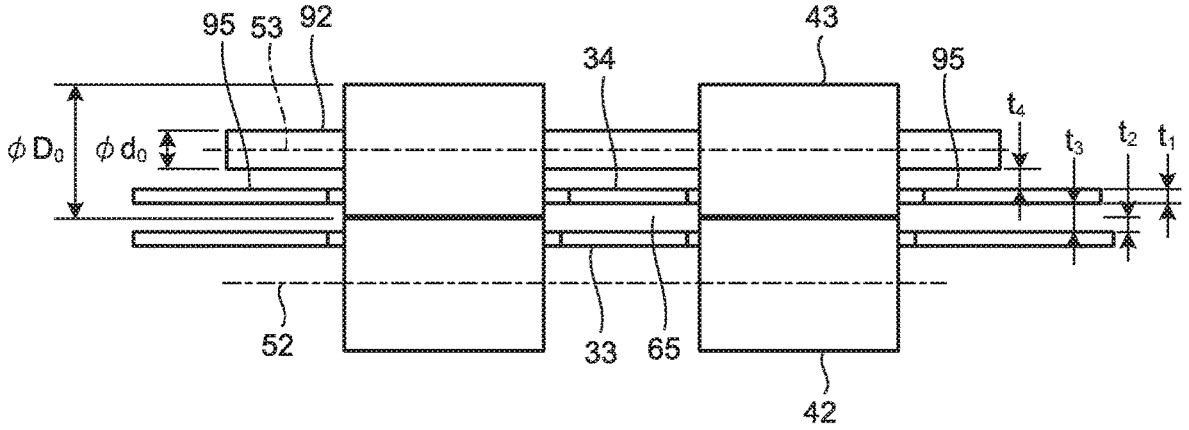
FIG. 14 is another sectional view illustrating the conveyor.

FIG. 14 is another sectional view illustrating the conveyor 31. The pinch roller 43 is formed, as illustrated in FIG. 14, to have a diameter equal to a predetermined diameter Do. The pinch roller shaft 92 is formed to have a diameter equal to a predetermined diameter do. The pinch roller shaft suspending portion 95 is formed, such that an upper surface thereof opposite to the pinch roller shaft 92 is separated from the lower surface of the second conveyance guide 34 by a predetermined distance $t_1$. The first conveyance roller 42 is formed to protrude upward by a predetermined distance $t_2$ from the upper surface of the first conveyance guide 33. The second conveyance guide 34 is formed, such that when no medium is placed on the conveyance path 65, or when a thin medium is placed on the conveyance path 65, the lower surface of the second conveyance guide 34 is away from the upper surface of the first conveyance guide 33 by a predetermined distance $t_3$. When no medium is placed on the conveyance path 65 or when a thin medium is placed on the conveyance path 65, the pinch roller shaft suspending portion 95 is away from the pinch roller shaft 92 by a predetermined distance $t_4$ without contacting the pinch roller shaft 92.

Figure 15:
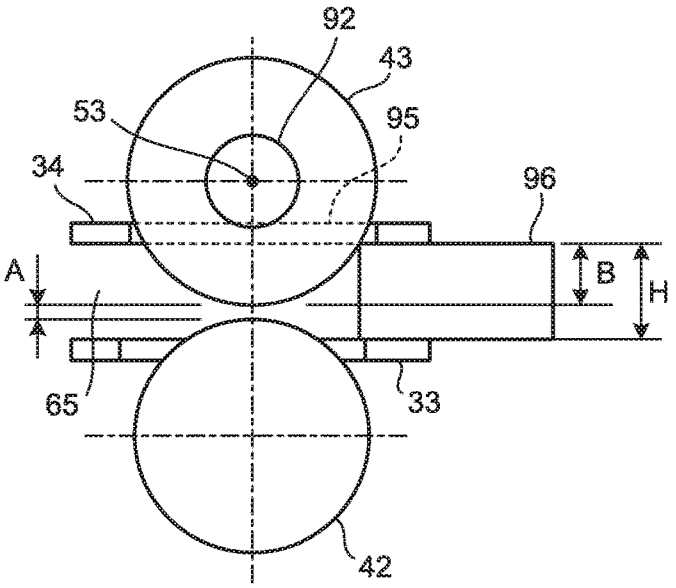
FIG. 15 is a sectional view illustrating a second conveyance guide and a first conveyance roller when a thick medium has been placed on a conveyance path.

FIG. 15 is a sectional view illustrating the second conveyance guide 34 and the first conveyance roller 42 when a thick medium has been placed on the conveyance path 65. The pinch roller shaft suspending portion 95 is formed, such that when a medium 96 having a thickness H is placed on the conveyance path 65, as illustrated in FIG. 15, the pinch roller protrudes downward from the lower surface of the second conveyance guide 34 by a predetermined distance B. That is, the predetermined distance B is expressed by the following equation.

$$B=D_0/2-(d_0/2+t_1)$$

Furthermore, when there is a gap between the first conveyance roller 42 and the pinch roller 43, a width A of that gap is expressed by the following equation.

$$A=H-t_3-t_4$$

Figure 16:
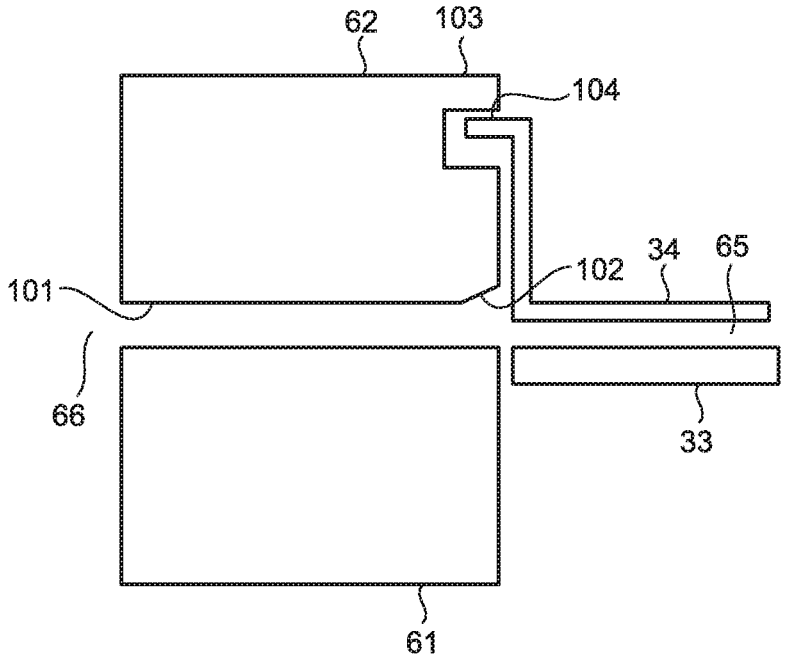
FIG. 16 is a schematic side view illustrating the reader and the second conveyance guide.

FIG. 16 is a schematic side view illustrating the reader 32 and the second conveyance guide 34. The upper image sensor 62 of the reader 32 has, as illustrated in FIG. 16, a sensor surface 101, a C-cut portion 102, and an engagement portion 103, formed therein. The sensor surface 101 is formed flatly, and is formed to be parallel to a plane that is along the conveyance path 65 and to face downward. The upper image sensor 62 reads an image on a read surface of a medium conveyed between the conveyance path 65 and the conveyance path 66, the read surface being opposite to the upper image sensor 62. The C-cut portion 102 is formed substantially flatly, and is formed at an end of the sensor surface 101, the end being at a back side of the sensor surface 101. The C-cut portion 102 is adjacent to the sensor surface 101, and is inclined so that a distance from a first point of the C-cut portion 102 to a conveyance plane is greater than a distance from a second point of the C-cut portion 102 to the conveyance plane. The conveyance plane is along a sliding surface of the second conveyance guide 34 that slides along the medium. The second point is closer to the sensor surface 101 than the first point. For example, a distance from an end of the C-cut portion 102 at the side of the second conveyance guide 34 to the conveyance plane is greater than a distance from an end of the C-cut portion 102 at the side of the sensor surface 101 to the conveyance plane. The engagement portion 103 is formed in an upper portion on a side surface of the upper image sensor 62, the side surface being at the back side, and is formed to protrude to the back side.

The second conveyance guide 34 includes an image sensor engagement portion 104. The image sensor engagement portion 104 is arranged below the engagement portion 103, and is fixed to the second conveyance guide 34.

Figure 17:
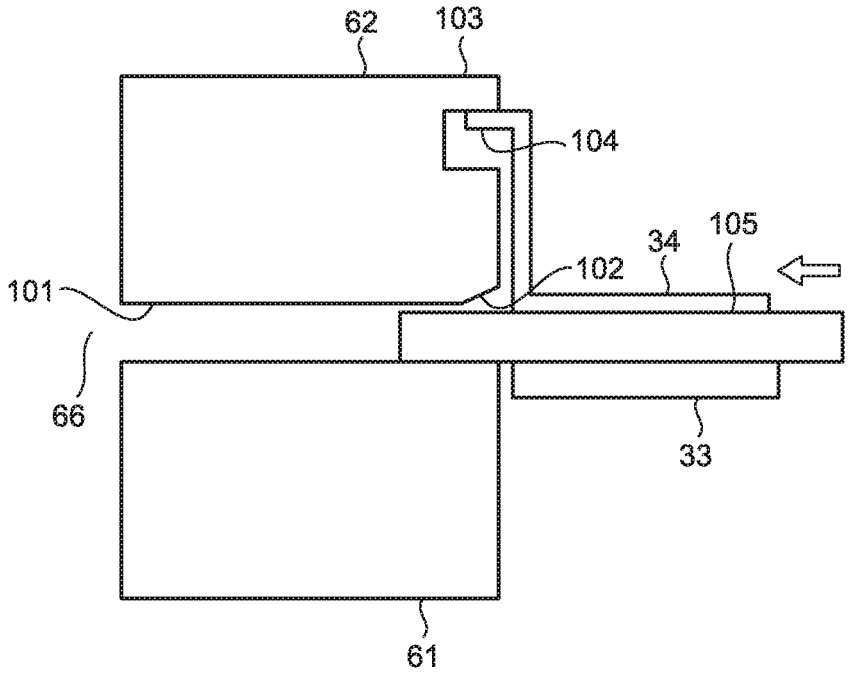
FIG. 17 is a schematic side view illustrating the reader and the second conveyance guide when a thick medium is conveyed through the conveyance path.

FIG. 17 is a schematic side view illustrating the reader 32 and the second conveyance guide 34 when a thick medium 105 is conveyed on the conveyance path 65. When the thick medium 105 is conveyed on the conveyance path 65, as illustrated in FIG. 17, the second conveyance guide 34 is lifted. When the second conveyance guide 34 has not been lifted to a predetermined height, the image sensor engagement portion 104 is not in contact with the engagement portion 103 of the upper image sensor 62. When the second conveyance guide has been lifted to the predetermined height, the image sensor engagement portion 104 is in contact with the engagement portion 103 of the upper image sensor 62. When the second conveyance guide 34 is lifted further in the state where the image sensor engagement portion 104 is in contact with the engagement portion 103, the image sensor engagement portion 104 lifts the engagement portion 103 and thereby lifts the upper image sensor 62. The engagement portion 103 and the image sensor engagement portion 104 are formed, such that the sensor surface 101 is arranged above a plane that is along the lower surface of the second conveyance guide 34 when the image sensor engagement portion 104 is in contact with the engagement portion 103.

Figure 18:
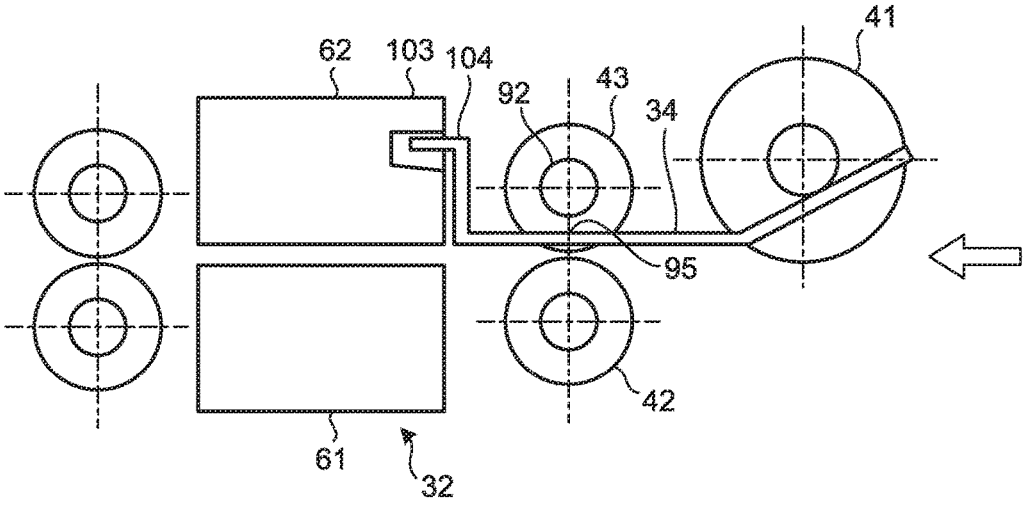
FIG. 18 is a schematic side view illustrating the reader and the second conveyance guide when no medium is placed on the conveyance path.

FIG. 18 is a schematic side view illustrating the reader 32 and the second conveyance guide 34 when no medium is placed on the conveyance path 65. The second conveyance guide is formed, such that, as illustrated in FIG. 18, the engagement portion 103 and the image sensor engagement portion 104 are not in contact with each other when no medium is placed on the conveyance path 65.

Figure 19:
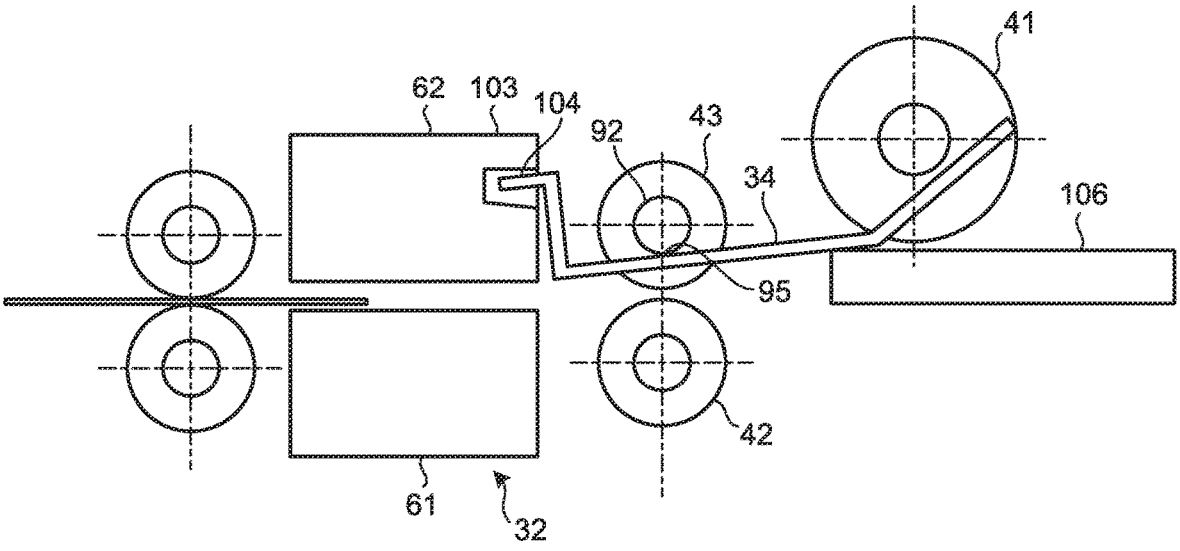
FIG. 19 is a schematic side view illustrating the reader and the second conveyance guide when a thick medium comes into contact with a part of the second conveyance guide, the part being at a back side of the second conveyance guide.

FIG. 19 is a schematic side view illustrating the reader 32 and the second conveyance guide 34 when a thick medium 106 comes into contact with a part of the second conveyance guide 34, the part being at the back side of the second conveyance guide 34. When the thick medium 106 comes into contact with a part of the lower surface of the second conveyance guide 34, the part being at the back side of the second conveyance guide 34, as illustrated in FIG. 19, the second conveyance guide 34 becomes inclined such that the back side of the second conveyance guide 34 becomes higher than the front side of the second conveyance guide 34. When the thick medium 106 is conveyed, such that the thick medium 106 comes into contact with a portion of the lower surface of the second conveyance guide 34, the portion being near the pinch roller shaft suspending portion 95, the second conveyance guide 34 moves, such that the upper surface of the first conveyance guide 33 and the lower surface of the second conveyance guide 34 become parallel to each other (see FIG. 17).

Figure 20:
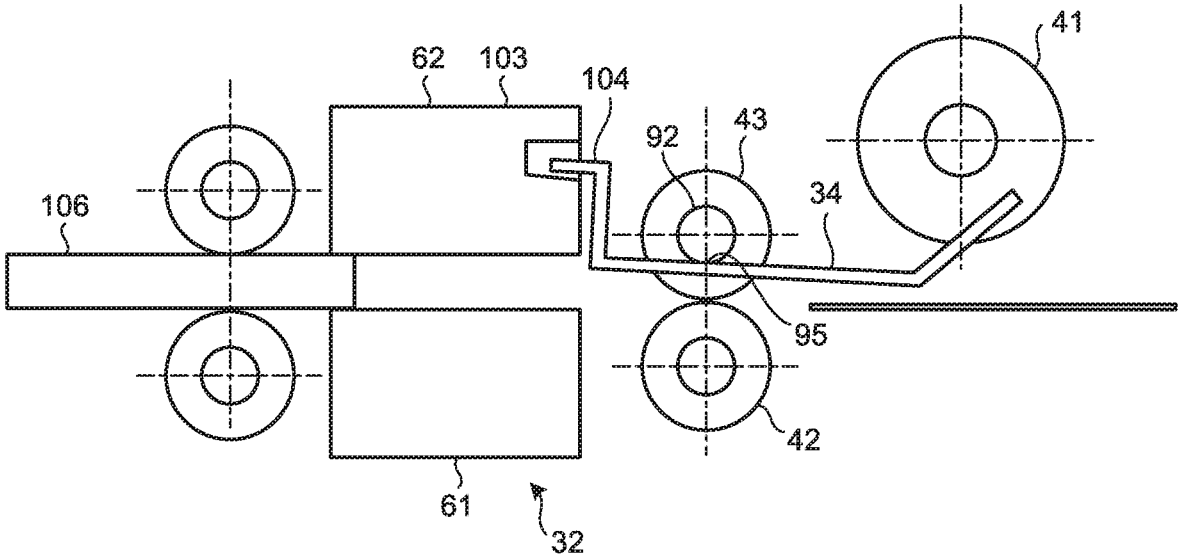
FIG. 20 is a schematic side view illustrating the second conveyance guide when the reader is reading the thick medium.

FIG. 20 is a schematic side view illustrating the second conveyance guide 34 when the reader 32 is reading the thick medium 106. When the thick medium 106 has been conveyed until the thick medium 106 is no longer in contact with the second conveyance guide 34, as illustrated in FIG. 20, the second conveyance guide 34 starts to be lowered and is lowered until the second conveyance guide 34 reaches a position illustrated in FIG. 18.

Figure 21:
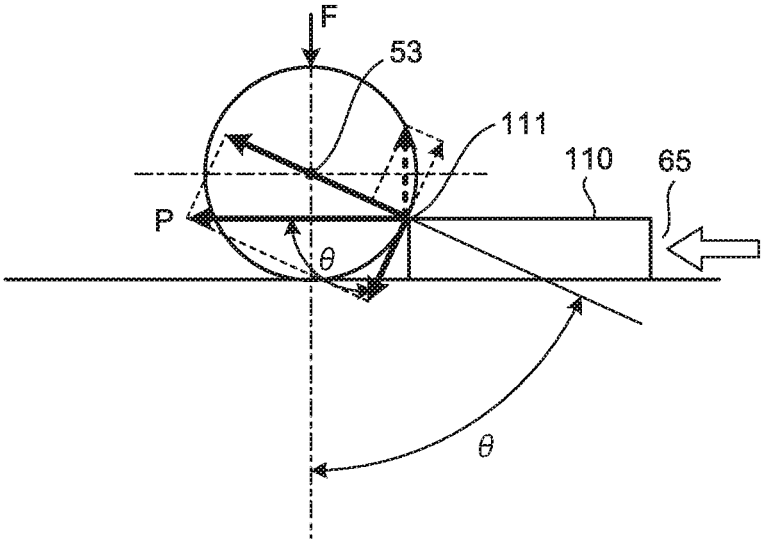
FIG. 21 is a sectional view illustrating force applied to the pinch roller when a thick medium comes into contact with the pinch roller.

FIG. 21 is a sectional view illustrating force applied to the pinch roller 43 when a thick medium 110 comes into contact with the pinch roller 43. As illustrated in FIG. 21, an elastic force F has been exerted on the pinch roller 43 from the compression coil spring 94. The pinch roller 43 contacts the thick medium 110 conveyed on the conveyance path 65 at a point 111. An angle θ in FIG. 21 represents an angle formed between a straight line joining the point 111 and the rotation axis 53 of the pinch roller 43 and a straight line perpendicular to the upper surface of the first conveyance guide 33. By the thick medium 110 being conveyed on the conveyance path 65, a force P is exerted on the point 111 on the pinch roller 43, from the thick medium 110. The thick medium 110 causes the pinch roller 43 to rotate and is able to be inserted between the first conveyance roller 42 and the pinch roller 43 when Expression (1) below using a coefficient of static friction μ is satisfied.

$$P\cos\theta+\mu P\sin\theta+\mu F\cos\theta>F\sin\theta \quad (1)$$

The coefficient of static friction μ represents a ratio between a frictional force acting between the pinch roller 43 and the thick medium 110 and a normal force acting between the pinch roller 43 and the thick medium 110. The above Expression (1) is satisfied when, for example, the angle θ is expressed by Expression (2) below, where the force P is 1 kgf, the elastic force F is 1 kgf, and the coefficient of static friction μ is 0.4.

$$0°\leq\theta<66.8° \quad (2)$$

That is, the thick medium 110 is able to be inserted between the first conveyance roller 42 and the pinch roller 43 when a distance from the rotation axis 53 of the pinch roller 43 to the upper surface of the thick medium 110 is larger than a length that is ⅙ of the diameter $D_0$ of the pinch roller 43. Therefore, the second conveyance guide 34 and the pinch roller shaft suspending portion 95 are formed, such that the distance from the rotation axis 53 of the pinch roller 43 to the lower surface of the second conveyance guide 34 becomes larger than the length that is ⅙ of the diameter Do of the pinch roller 43.

The medium conveying apparatus 1 further includes a thickness sensor, a switching guide driving device, and a control device, which are not illustrated in the drawings. The thickness sensor measures a thickness of a medium conveyed on the conveyance path 65. The switching guide driving device moves the switching guide 38. Based on the thickness of the medium measured by the thickness sensor, the control device controls the switching guide driving device for the switching guide 38, such that the switching guide 38 is placed at either the U-turn path guiding position or the straight path guiding position. That is, when the thickness of the medium measured by the thickness sensor is less than a predetermined threshold, the control device controls the switching guide driving device for the switching guide 38, such that the switching guide 38 is placed at the U-turn path guiding position. When the thickness of the medium measured by the thickness sensor is larger than the predetermined threshold, the control device controls the switching guide driving device for the switching guide 38, such that the switching guide 38 is placed at the straight path guiding position.

Operation of Medium Conveying Apparatus

When a user desires to read an image of a medium by using the medium conveying apparatus 1, the user firstly extends the shooter 3 by expanding the shooter 3. After expanding and extending the shooter 3, the user places the medium desired to be read by using the medium conveying apparatus 1, onto the shooter placement surface 11. After placing the medium on the shooter placement surface 11, the user extends the stacker 6 by expanding the stacker 6, such that the stacker 6 is placed in the stacker expansion region 19. After the stacker 6 has been placed in the stacker expansion region 19, the user operates the medium conveying apparatus 1, such that the image of the medium placed on the shooter 3 is read by the medium conveying apparatus 1.

When the medium conveying apparatus 1 is operated by the user, the conveyor 31 causes the pick roller 41, the first conveyance roller 42, the second conveyance roller 44, the third conveyance roller 45, the fourth conveyance roller 46, and the fifth conveyance roller 47, to rotate normally. By the pick roller 41 rotating normally, the conveyor 31 conveys media that have been placed on the shooter placement surface 11, one by one, from the shooter placement surface 11, onto the conveyance path 65.

The second conveyance guide 34 is not lifted when a thin medium is supplied to the conveyance path 65, and the second conveyance guide 34 is lifted when a thick medium is supplied to the conveyance path 65. When the second conveyance guide 34 has been lifted to a predetermined height or higher before the pinch roller 43 contacts the medium conveyed on the conveyance path 65, the pinch roller 43 is lifted in cooperation with the lift of the second conveyance guide 34. When the pinch roller 43 contacts the medium, the pinch roller 43 is rotated by a force that conveys the medium, and presses the medium against the first conveyance roller 42. The medium that has been pressed against the first conveyance roller 42 is conveyed through the conveyance path 65 by the normal rotation of the first conveyance roller 42. The medium conveyed through the conveyance path 65 is supplied to the reader 32. The medium conveyed through the conveyance path 65 slides along the C-cut portion 102, is guided to a region below the sensor surface 101, and is supplied to the conveyance path 66, due to the formation of the C-cut portion 102 in the upper image sensor 62. That is, by the formation of the C-cut portion 102 in the upper image sensor 62, the medium conveyed through the conveyance path 65 is prevented from advancing upward into a gap between the upper image sensor 62 and the second conveyance guide 34. The medium supplied onto the conveyance path 66 is conveyed through the conveyance path 66 by the normal rotation of the second conveyance roller 44 and third conveyance roller 45.

When the medium is conveyed between the conveyance path 65 and the conveyance path 66, the reader 32 comes into contact with a lower read surface of the medium and reads an image of that lower read surface, and the upper image sensor 62 comes into contact with an upper read surface of the medium and reads an image of that upper read surface.

By controlling the thickness sensor, the control device of the medium conveying apparatus 1 measures a thickness of that medium. When the thickness of the medium is less than the predetermined threshold, by controlling the switching guide driving device, the control device of the medium conveying apparatus 1 places the switching guide 38 at the U-turn path guiding position. When the thickness of the medium is greater than the predetermined threshold, by controlling the switching guide driving device, the control device of the medium conveying apparatus 1 places the switching guide 38 at the straight path guiding position.

When the switching guide 38 is at the U-turn path guiding position, the switching guide 38 guides the medium conveyed through the conveyance path 66 to the U-turn conveyance path 67. The medium guided to the U-turn conveyance path 67 is conveyed on the U-turn conveyance path 67 by the normal rotation of the fourth conveyance roller 46 and fifth conveyance roller 47, and is placed onto the stacker placement surface 15 of the stacker 6. When the switching guide 38 is at the straight path guiding position, the switching guide 38 guides the medium conveyed through the conveyance path 66 to the straight conveyance path 68. The conveyor 31 ejects the medium that has been guided to the straight conveyance path 68, to the exterior of the housing 2.

Examples of a medium having a thickness less than the predetermined threshold include a sheet of paper. Such a medium has flexibility, is hard to be curled even if the medium is conveyed through the U-turn conveyance path 67, and paper jamming on the U-turn conveyance path 67 is hard to be caused by use of this medium. Examples of a medium having a thickness larger than the predetermined threshold include a thick sheet of paper, and a plastic card, such as a credit card. Such a medium is easily curled when the medium is conveyed through the U-turn conveyance path 67, or paper jamming on the U-turn conveyance path 67 is easily caused by use of this medium. According to the above described operation of the medium conveying apparatus 1, by any thick medium being ejected via the straight conveyance path 68 without being conveyed through the U-turn conveyance path 67, the thick medium is hard to be curled, and paper jamming on the U-turn conveyance path 67 is hard to be caused by use of the thick medium.

Medium Conveying Apparatus According to First Comparative Example

Figure 22:
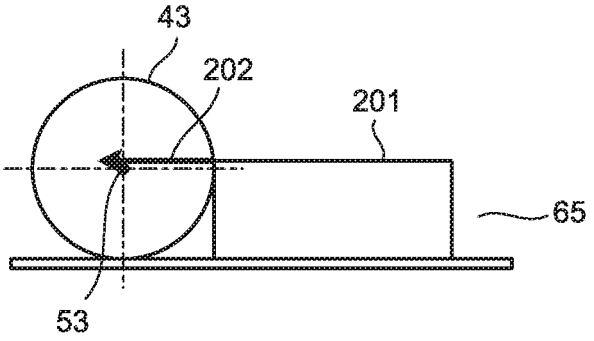
FIG. 22 is a side view illustrating a pinch roller of a medium conveying apparatus according to a first comparative example.

FIG. 22 is a side view illustrating the pinch roller 43 of a medium conveying apparatus according to a first comparative example. The medium conveying apparatus according to the first comparative example corresponds to the above described medium conveying apparatus 1 without the pinch roller shaft suspending portion 95, which means that the pinch roller 43 is not lifted in association with the lift of the second conveyance guide 34. When a thick medium 201 is conveyed onto the conveyance path 65, as illustrated in FIG. 22, a portion of the outer periphery of the pinch roller 43 of the medium conveying apparatus according to the first comparative example may collide with an end face of the thick medium 201, the portion intersecting a horizontal plane including the rotation axis 53, the end face being at a front side of the thick medium 201. When that portion collides with the thick medium 201, a force 202 that conveys the thick medium 201 is not converted to a force that rotates the pinch roller 43 normally, and thus the pinch roller 43 does not rotate. Since the pinch roller 43 does not rotate, the thick medium 201 is not conveyed forward by the pinch roller 43 and thus paper jamming is caused on the conveyance path 65.

In contrast to the medium conveying apparatus according to the first comparative example, the above described medium conveying apparatus 1 according to the embodiment enables paper jamming on the conveyance path 65 to be prevented because the pinch roller 43 is lifted in association with the lift of the second conveyance guide 34.

Medium Conveying Apparatus According to Second Comparative Example

Figure 23:
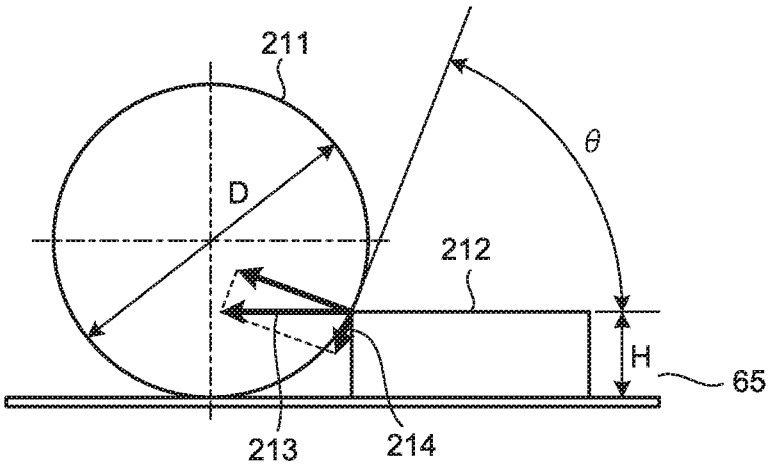
FIG. 23 is a side view illustrating a pinch roller of a medium conveying apparatus according to a second comparative example.

FIG. 23 is a side view illustrating a pinch roller of a medium conveying apparatus according to a second comparative example. As illustrated in FIG. 23, the medium conveying apparatus according to the second comparative example corresponds to the above described medium conveying apparatus 1 without the pinch roller shaft suspending portion 95, and has another pinch roller 211 replacing the pinch roller 43 of the above described medium conveying apparatus 1. A diameter D of the pinch roller 211 is sufficiently large, relatively to a thickness H of a thick medium 212 that may be conveyed by the conveyor 31. Therefore, when the pinch roller 211 comes into contact with the thick medium 212, the pinch roller 211 is rotated by a component force 214 of a force 213 that conveys the thick medium 212, and presses the thick medium 212 against the first conveyance roller 42. That is, by the diameter D of the pinch roller 211 being formed sufficiently largely relatively to the thickness H of the thick medium 212, the pinch roller 211 enables prevention of paper jamming on the conveyance path 65. However, by the diameter D of the pinch roller 211 being formed largely, the scale of size of the medium conveying apparatus according to the second comparative example needs be increased.

The above described medium conveying apparatus 1 according to the embodiment enables the pinch roller 43 to rotate appropriately and a medium to be conveyed appropriately through the conveyance path 65, even if the diameter of the pinch roller 43 is small, because the pinch roller 43 is lifted in association with the lift of the second conveyance guide 34.

Medium Conveying Apparatus According to Third Comparative Example

Figure 24:
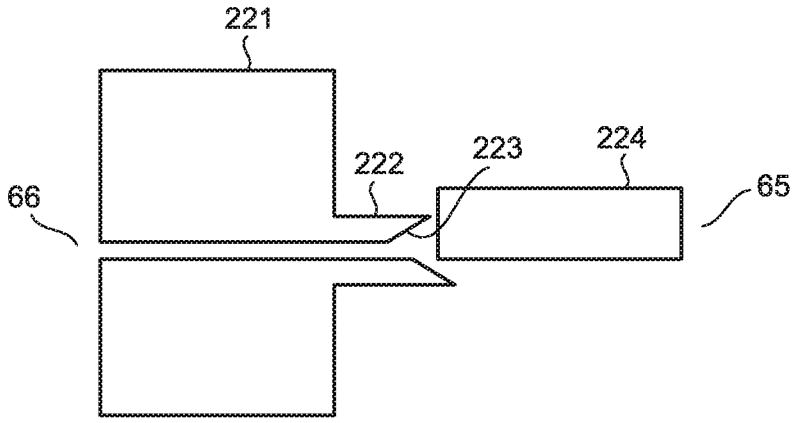
FIG. 24 is a side view illustrating a reader of a medium conveying apparatus according to a third comparative example.

FIG. 24 is a side view illustrating a reader of a medium conveying apparatus according to a third comparative example. As illustrated in FIG. 24, the medium conveying apparatus according to the third comparative example corresponds to the above described medium conveying apparatus 1 without the image sensor engagement portion 104 in the second conveyance guide 34, and has another upper image sensor 221 replacing the upper image sensor 62 of the above described medium conveying apparatus 1 according to the embodiment. In the medium conveying apparatus according to the third comparative example, due to the absence of the image sensor engagement portion 104, the upper image sensor 221 is not lifted in association with the lift of the second conveyance guide 34. Similarly to the upper image sensor 62, the upper image sensor 221 reads an image of an upper read surface of a medium conveyed between the conveyance path 65 and the conveyance path 66.

The upper image sensor 221 includes a guide portion 222. The guide portion 222 has a guide surface 223 formed thereon. The guide surface 223 is formed substantially flatly, is adjacent to a lower surface of the upper image sensor 221, and is inclined to be lower toward the upper image sensor 221 from a back side of the guide surface 223. By contact between the guide surface and a medium 224 conveyed between the conveyance path 65 and the conveyance path 66, the guide portion 222 lifts the upper image sensor 221. That is, by lifting the upper image sensor 221, the guide portion 222 guides the medium 224, such that the image of the upper read surface of the medium 224 conveyed between the conveyance path and the conveyance path 66 is appropriately read by the upper image sensor 221. Furthermore, by lifting the upper image sensor 221, the guide portion 222 prevents the medium 224 from colliding with the upper image sensor 221 and prevents paper jamming.

However, in the medium conveying apparatus according to the third comparative example, when the medium 224 is sufficiently thick, the medium 224 may collide with the guide portion 222 without coming into contact with the guide surface 223 of the guide portion 222. In the medium conveying apparatus according to the third comparative example, when the medium 224 does not come into contact with the guide surface 223, the medium 224 may collide with the upper image sensor 221 and paper jamming may be caused, because the guide portion 222 is unable to lift the upper image sensor 221. By the guide surface 223 being formed largely, the medium conveying apparatus according to the third comparative example enables the upper image sensor 221 to be lifted and paper jamming to be prevented, even if the medium 224 is sufficiently thick. However, by the guide surface 223 being formed largely, the scale of size of the medium conveying apparatus according to the third comparative example needs be increased.

In contrast to the medium conveying apparatus according to the third comparative example, the above described medium conveying apparatus 1 according to the embodiment enables paper jamming at the upper image sensor 62 to be prevented and the scale of size of the medium conveying apparatus 1 to be decreased, because the upper image sensor 62 is lifted in association with the lift of the second conveyance guide 34.

Medium Conveying Apparatus According to Fourth Comparative Example

Figure 25:
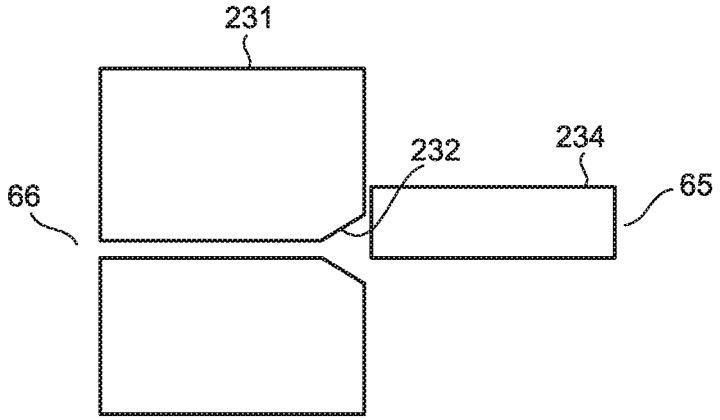
FIG. 25 is a side view illustrating a reader of a medium conveying apparatus according to a fourth comparative example.

FIG. 25 is a side view illustrating a reader of a medium conveying apparatus according to a fourth comparative example. As illustrated in FIG. 25, the medium conveying apparatus according to the fourth comparative example corresponds to the above described medium conveying apparatus 1 without the image sensor engagement portion 104 in the second conveyance guide 34, and has another upper image sensor 231 replacing the upper image sensor 62 of the above described medium conveying apparatus 1 according to the embodiment. In the medium conveying apparatus according to the fourth comparative example, due to the absence of the image sensor engagement portion 104, the upper image sensor 231 is not lifted in association with the lift of the second conveyance guide 34. Similarly to the upper image sensor 62, the upper image sensor 231 reads an image of an upper read surface of a medium conveyed between the conveyance path 65 and the conveyance path 66.

The upper image sensor 231 has a guide surface 232 formed thereon. The guide surface 232 is formed substantially flatly, is adjacent to a lower surface of the upper image sensor 231, and is inclined to be higher backward and farther from the upper image sensor 231. By coming into contact with a medium 234 conveyed between the conveyance path 65 and the conveyance path 66, the guide surface 232 lifts the upper image sensor 231. That is, by lifting the upper image sensor 231, the guide surface 232 guides the medium 234, such that the image of the upper read surface of the medium 234 conveyed between the conveyance path 65 and the conveyance path 66 is appropriately read by the upper image sensor 221. Furthermore, by lifting the upper image sensor 231, the guide surface 232 prevents the medium 234 from colliding with the upper image sensor 231 and prevents paper jamming.

However, in the medium conveying apparatus according to the fourth comparative example, when the medium 234 is sufficiently thick, the medium 234 may collide with a back end face of the upper image sensor 231 without coming into contact with the guide surface 232. In the medium conveying apparatus according to the fourth comparative example, when the medium 234 does not come into contact with the guide surface 232, the medium 234 may collide with the upper image sensor 231 and paper jamming may be caused, because the medium 234 is unable to lift the upper image sensor 231. By the guide surface 232 being formed largely in the medium conveying apparatus according to the fourth comparative example, the upper image sensor 231 is able to be lifted and paper jamming is able to be prevented even if the medium 234 is sufficiently thick. However, by the guide surface 232 being formed largely, the upper image sensor 231 needs to be increased in size, and the scale of size of the medium conveying apparatus according to the fourth comparative example needs be increased.

In contrast to the medium conveying apparatus according to the fourth comparative example, the above described medium conveying apparatus 1 according to the embodiment enables paper jamming at the upper image sensor 62 to be prevented and the scale of size of the medium conveying apparatus 1 to be decreased because the upper image sensor 62 is lifted in association with the lift of the second conveyance guide 34.

Medium Conveying Apparatus According to Fifth Comparative Example

Figure 26:
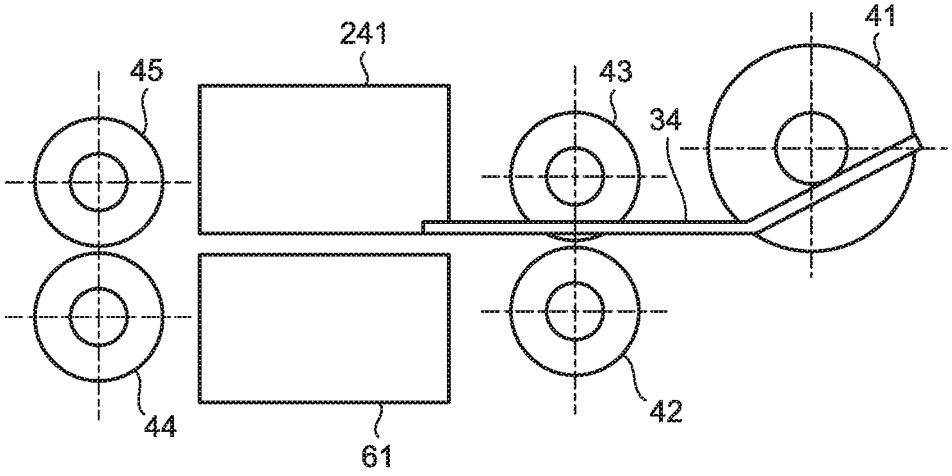
FIG. 26 is a side view illustrating an upper image sensor of a medium conveying apparatus according to a fifth comparative example.

FIG. 26 is a side view illustrating an upper image sensor 241 of a medium conveying apparatus according to a fifth comparative example. As illustrated in FIG. 26, the medium conveying apparatus according to the fifth comparative example corresponds to the above described medium conveying apparatus 1 having another upper image sensor 241 replacing the upper image sensor 62. Similarly to the upper image sensor 62, the upper image sensor 241 reads an image of an upper read surface of a medium conveyed between the conveyance path 65 and the conveyance path 66. The upper image sensor 241 is fixed to the second conveyance guide 34. Therefore, the upper image sensor 241 is lifted with the second conveyance guide 34.

Figure 27:
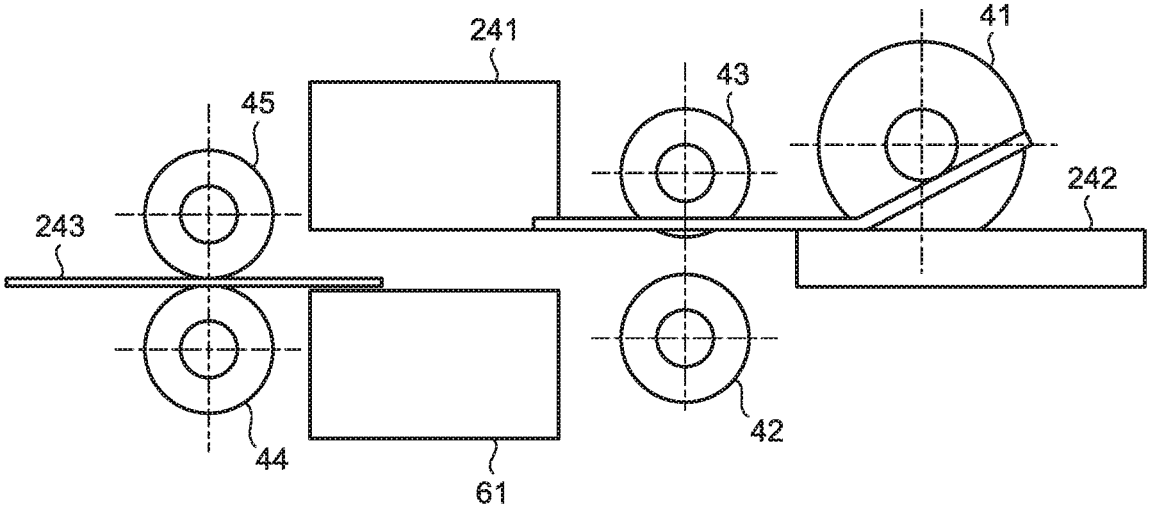
FIG. 27 is a side view illustrating the upper image sensor of the medium conveying apparatus according to the fifth comparative example when a thick medium is being conveyed on a conveyance path.

FIG. 27 is a side view illustrating the upper image sensor 241 of the medium conveying apparatus according to the fifth comparative example when a thick medium 242 is being conveyed on the conveyance path 65. The upper image sensor 241 has been lifted with the second conveyance guide 34, as illustrated in FIG. 27, when the thick medium 242 is being conveyed on the conveyance path 65. By being lifted with the second conveyance guide 34, the upper image sensor 241 may be lifted or vibrated while the upper image sensor 241 is reading an image of a thin medium 243 that has been conveyed before the thick medium 242. Due to the lift or vibration during the reading of the image of the thin medium 243, the upper image sensor 241 may be unable to appropriately read the image of the thin medium 243.

In the above described medium conveying apparatus 1 according to the embodiment, when the second conveyance guide 34 has not been lifted to the predetermined height, the image sensor engagement portion 104 of the second conveyance guide 34 is not in contact with the engagement portion 103 of the upper image sensor 62. In the above described medium conveying apparatus 1 according to the embodiment, due to this non-contact between the image sensor engagement portion 104 and the engagement portion 103, even if the second conveyance guide 34 is vibrated, that vibration is hard to be transmitted to the upper image sensor 62. The above described medium conveying apparatus 1 according to the embodiment enables an image of a medium to be read more appropriately than the medium conveying apparatus according to the fifth comparative example because vibration of the second conveyance guide 34 is hard to be transmitted to the upper image sensor 62.

Medium Conveying Apparatus According to Sixth Comparative Example

Figure 28:
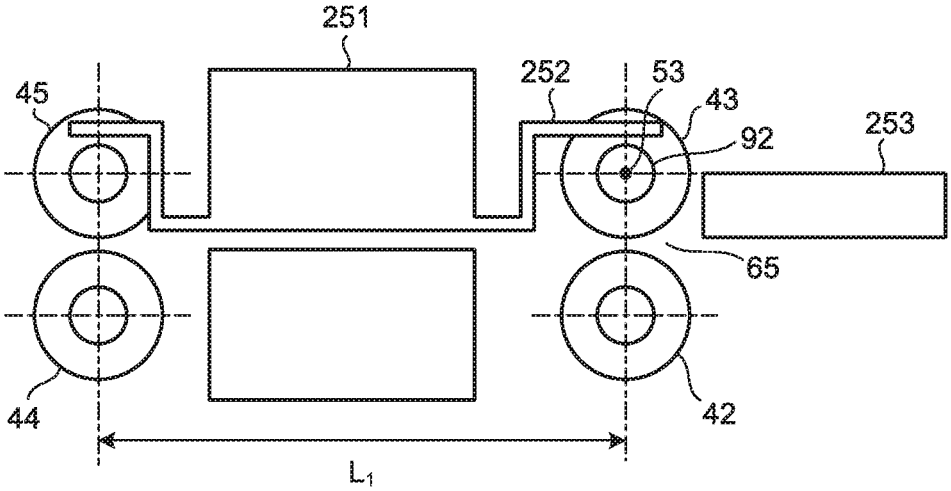
FIG. 28 is a side view illustrating a conveyance guide of a medium conveying apparatus according to a sixth comparative example.

FIG. 28 is a side view illustrating a conveyance guide of a medium conveying apparatus according to a sixth comparative example. As illustrated in FIG. 28, the medium conveying apparatus according to the sixth comparative example corresponds to the above described medium conveying apparatus 1 without the pinch roller shaft suspending portion 95, and has another upper image sensor 251 replacing the upper image sensor 62. In the medium conveying apparatus according to the sixth comparative example, due to the absence of the pinch roller shaft suspending portion 95, the pinch roller 43 is not lifted in association with the lift of the second conveyance guide 34. Similarly to the upper image sensor 62, the upper image sensor 251 reads an image of an upper read surface of a medium conveyed between the conveyance path 65 and the conveyance path 66. The upper image sensor 251 includes a pinch roller shaft suspending portion 252. The pinch roller shaft suspending portion 252 is arranged above the pinch roller shaft 92 and fixed to the upper image sensor 251. When the pinch roller 43 is lifted, the pinch roller shaft suspending portion 252 is lifted by coming into contact with the pinch roller shaft 92. The upper image sensor 251 is lifted by the lift of the pinch roller shaft suspending portion 252.

In the medium conveying apparatus according to the sixth comparative example, when a thick medium 253 is conveyed on the conveyance path 65, the pinch roller shaft 92 is lifted because the pinch roller 43 rolls over an upper surface of a thick medium 253. When the pinch roller 43 is lifted, the pinch roller shaft suspending portion 252 lifts the upper image sensor 251 by coming into contact with the pinch roller shaft 92. In the medium conveying apparatus according to the sixth comparative example, the thick medium 253 is able to be prevented from colliding with the upper image sensor 251 and paper jamming at the upper image sensor 251 is able to be prevented, because the upper image sensor 251 is lifted when the thick medium 253 is conveyed through the conveyance path 65.

Similarly to the pinch roller 43 of the medium conveying apparatus according to the first comparative example, the pinch roller 43 may not rotate and may be not lifted when the thick medium 253 is sufficiently thick. In the medium conveying apparatus according to the six comparative example, the upper image sensor 251 is unable to be lifted when the pinch roller 43 is not lifted.

Medium Conveying Apparatus According to Seventh Comparative Example

Figure 29:
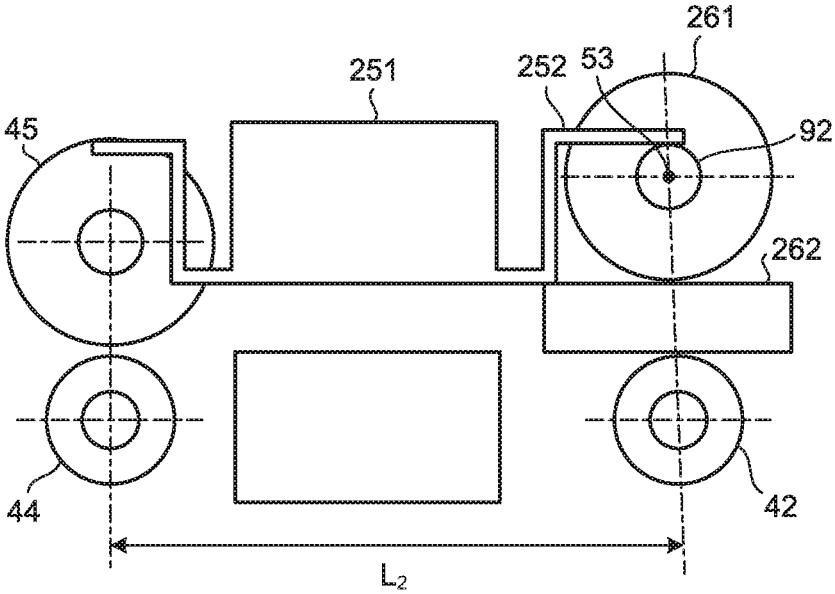
FIG. 29 is a side view illustrating a conveyance guide of a medium conveying apparatus according to a seventh comparative example.

FIG. 29 is a side view illustrating a conveyance guide of a medium conveying apparatus according to a seventh comparative example. As illustrated in FIG. 29, the medium conveying apparatus according to the seventh comparative example corresponds to the above described medium conveying apparatus according to the sixth comparative example having another pinch roller 261 replacing the pinch roller 43. Similarly to the pinch roller 211 of the above described medium conveying apparatus according to the second comparative example, the pinch roller 261 has a diameter that is sufficiently large relatively to a thickness of a thick medium 262 conveyed on the conveyance path 65. Therefore, when the pinch roller 261 comes into contact with the thick medium 262, the pinch roller 261 is rotated by a force that conveys the thick medium 262, and presses the thick medium 262 against the first conveyance roller 42.

In the medium conveying apparatus according to the seventh comparative example, even if the thick medium 262 is thick to a certain extent, the pinch roller shaft 92 is able to be lifted, because the diameter of the pinch roller 261 is large. Therefore, in the medium conveying apparatus according to the seventh comparative example, even if the thick medium 262 is thick to a certain extent, the upper image sensor 251 is able to be lifted, and paper jamming at the upper image sensor 251 is able to be prevented.

However, in the medium conveying apparatus according to the seventh comparative example, as compared to the rotation axis 53 of the pinch roller 43 of the above described medium conveying apparatus according to the sixth comparative example, the rotation axis 53 of the pinch roller 261 needs to be separated backward from the upper image sensor 251 because the diameter of the pinch roller 261 is large. Therefore, a span $L_2$ between the first conveyance roller 42 and the second conveyance roller 44 of the medium conveying apparatus according to the seventh comparative example needs to be made larger than a span $L_1$ of the medium conveying apparatus according to the sixth comparative example. Since the span $L_2$ of the medium conveying apparatus according to the seventh comparative example is large, the minimum paper size of conveyable media in a conveyance direction thereof is increased.

The above described medium conveying apparatus 1 according to the embodiment enables the diameter of the pinch roller 43 to be more decreased as compared to that in the medium conveying apparatus according to the seventh comparative example, because the pinch roller 43 is lifted in association with the lift of the second conveyance guide 34. Therefore, as compared to the medium conveying apparatus according to the seventh comparative example, the above described medium conveying apparatus 1 enables the span between the first conveyance roller 42 and the second conveyance roller 44 to be decreased, and the minimum paper size of conveyable media in the conveyance direction to be decreased.

Effects of Medium Conveying Apparatus

The medium conveying apparatus 1 according to the embodiment includes the second conveyance guide 34, the first conveyance roller 42, and the pinch roller 43. The second conveyance guide 34 is supported by the frame 20, so as to be able to be lifted and lowered, and guides a medium to the conveyance path 65 by sliding along an upper surface of the medium. The first conveyance roller 42 is rotatably supported by the frame 20, and conveys the medium by coming into contact with a lower surface of the medium, the lower surface being on the reverse side of the upper surface of the medium. The pinch roller 43 is supported by the frame 20, so as to be able to be lifted and lowered, and presses the medium against the first conveyance roller 42 by coming into contact with the upper surface of the medium. By being lifted and lowered relatively to the frame 20, the second conveyance guide 34 lifts and lowers the pinch roller 43 relatively to the frame 20 when the pinch roller 43 is not in contact with the medium.

In the medium conveying apparatus 1 described above, because the pinch roller 43 is lifted and lowered with the second conveyance guide 34, even if the diameter of the pinch roller 43 is small, a thick medium is able to be inserted between the first conveyance roller 42 and the pinch roller 43. In the medium conveying apparatus 1, by the thick medium being inserted between the first conveyance roller 42 and the pinch roller 43, the pinch roller 43 is able to press the thick medium against the first conveyance roller 42 appropriately. Furthermore, by reduction of the diameter of the pinch roller 43, the whole medium conveying apparatus 1 is able to be downsized.

Furthermore, the second conveyance guide 34 of the medium conveying apparatus 1 according to the embodiment lifts or lowers the pinch roller 43 relatively to the frame 20, such that a distance from the rotation axis 53 of the pinch roller 43 to the plane that is along the upper surface of the medium becomes larger than a length that is ⅙ of the diameter of the pinch roller 43. In the medium conveying apparatus 1 described above, the pinch roller 43 is able to roll over the surface of the medium appropriately, and the pinch roller 43 is able to press a thick medium against the first conveyance roller 42 appropriately.

In the medium conveying apparatus 1 according to the embodiment, the distance from the rotation axis 53 of the pinch roller 43 to the lower surface of the second conveyance guide 34 is larger than the length that is ⅙ of the diameter of the pinch roller 43, but that distance may be made smaller. In this case, in the medium conveying apparatus 1, when, for example, the elastic force of the compression coil spring 94 is small, or when a force that conveys a medium is large, the medium is able to be inserted between the first conveyance roller 42 and the pinch roller 43. Furthermore, in this case, by reduction of the diameter of the pinch roller 43, the whole medium conveying apparatus 1 is able to be downsized.

Furthermore, the medium conveying apparatus 1 according to the embodiment further includes the upper image sensor 62, which is supported by the frame 20, so as to be able to be lifted and lowered, and which reads an image having an upper surface of a medium captured therein after the medium has been conveyed through the conveyance path 65. By being lifted and lowered relatively to the frame 20, the second conveyance guide 34 lifts and lowers the upper image sensor 62 relatively to the frame 20 when the upper image sensor 62 is not in contact with the medium.

In the medium conveying apparatus 1 described above, by the upper image sensor 62 being lifted or lowered with the second conveyance guide 34, the medium is able to be prevented from being jammed at the upper image sensor 62 when the medium is conveyed near the upper image sensor 62. By the medium being prevented from being jammed at the upper image sensor 62, the medium conveying apparatus 1 enables the medium to be conveyed appropriately to a region near the upper image sensor 62, and the medium to be read appropriately.

In addition, the medium conveying apparatus 1 according to the embodiment further includes the image sensor engagement portion 104 that is fixed to the second conveyance guide 34. By the image sensor engagement portion 104 being engaged with the upper image sensor 62, the upper image sensor 62 is lifted and lowered relatively to the frame 20. The image sensor engagement portion 104 is formed, such that the image sensor engagement portion 104 in not in contact with the upper image sensor 62 when a medium is not in contact with the second conveyance guide 34.

The medium conveying apparatus 1 described above enables vibration of the second conveyance guide 34 to be prevented from being transmitted to the upper image sensor 62, because the image sensor engagement portion 104 is not in contact with the upper image sensor 62 when a medium is not in contact with the second conveyance guide 34. In the medium conveying apparatus 1 described above, since vibration of the second conveyance guide 34 is not transmitted to the upper image sensor 62, the upper image sensor 62 is able to read a medium appropriately.

In the medium conveying apparatus 1 according to the embodiment, the upper image sensor 62 is lifted in association with the lift of the second conveyance guide 34 by use of the image sensor engagement portion 104, but the upper image sensor 62 may be lifted by use of a mechanism other than the image sensor engagement portion 104. Examples of this mechanism include the pinch roller shaft suspending portion 252 of the above described medium conveying apparatus according to the sixth comparative example. Even if the image sensor engagement portion 104 of the medium conveying apparatus according to the embodiment is substituted by the pinch roller shaft suspending portion 252, paper jamming is able to be prevented, and a medium is able to be read appropriately.

Furthermore, the image sensor engagement portion 104 of the medium conveying apparatus 1 according to the embodiment is formed, such that the upper image sensor 62 is arranged above the plane that is along the lower surface that slides along a medium, the lower surface being that of the second conveyance guide 34. In this medium conveying apparatus 1, by the upper image sensor 62 being arranged above the lower surface of the second conveyance guide 34, a medium is able to be prevented from being jammed at the upper image sensor 62.

The upper image sensor 62 of the medium conveying apparatus 1 according to the embodiment is arranged above the lower surface of the second conveyance guide 34, but the sensor surface 101 of the upper image sensor 62 may be arranged below the lower surface of the second conveyance guide 34. In such a medium conveying apparatus also, when the C-cut portion 102 has been formed in the upper image sensor 62, a medium is able to be prevented from being jammed at the upper image sensor 62, and the medium is thus able to be read appropriately.

Furthermore, the upper image sensor 62 of the medium conveying apparatus 1 according to the embodiment has the sensor surface 101 opposite to a medium, and a C-cut portion 102, formed thereon. An end of the sensor surface 101, the end being toward the second conveyance guide 34, has the C-cut portion 102 formed therein. The C-cut portion 102 is adjacent to the sensor surface 101 at the side of the second conveyance guide 34. The C-cut portion 102 is inclined so that a distance from an end of the C-cut portion 102 at the side of the second conveyance guide 34 to the conveyance plane is greater than a distance from an end of the C-cut portion 102 at the side of the sensor surface 101 to the conveyance plane.

By the C-cut portion 102 being formed in the upper image sensor 62, this medium conveying apparatus 1 enables a medium to be prevented from being jammed at the upper image sensor 62 and a medium to be prevented from going into a gap between the upper image sensor 62 and the second conveyance guide 34.

The upper image sensor 62 of the medium conveying apparatus 1 according to the embodiment has the C-cut portion 102 formed therein, but this C-cut portion 102 may be not formed therein. In the medium conveying apparatus 1 in that case also, when the upper image sensor 62 is arranged above the lower surface of the second conveyance guide 34, a medium is able to be prevented from being jammed at the upper image sensor 62, and the medium is able to be read appropriately.

Furthermore, the medium conveying apparatus 1 further includes the right front side guide pin 82, the left front side guide pin 84, the right back side guide pin 81, the left back side guide pin 83, the right front side supporting member 73, the left front side supporting member 75, the right back side supporting member 72, and the left back side supporting member 74. The right front side guide pin 82 and the left front side guide pin 84 are fixed to the frame 20. The right back side guide pin 81 and the left back side guide pin 83 are fixed to the frame 20, so as to be arranged at a position farther from the upper image sensor 62 than the right front side guide pin 82 and the left front side guide pin 84 are. The right front side supporting member 73, the left front side supporting member 75, the right back side supporting member 72, and the left back side supporting member 74 are fixed to the second conveyance guide 34. The right front side supporting member 73 has, formed therein, the slide groove 77 where the right front side guide pin 82 is fitted in. The left front side supporting member 75 has, formed therein, the slide groove 79 where the left front side guide pin 84 is fitted in. The right back side supporting member 72 has, formed therein, the slide groove 76 where the right back side guide pin 81 is fitted in. The left back side supporting member 74 has, formed therein, the slide groove 78 where the left back side guide pin 83 is fitted in. The second conveyance guide 34 is supported by the frame 20, so as to be able to be lifted and lowered, by the right back side guide pin 81, the right front side guide pin 82, the left back side guide pin 83, and the left front side guide pin 84 respectively moving along the slide grooves 76 to 79. The width G2 of the clearance between the right front side guide pin 82 and the slide groove 77 is less than the width G1 of the clearance between the right back side guide pin 81 and the slide groove 76. The width G2 of the clearance between the left front side guide pin 84 and the slide groove 79 is less than the width G1 of the clearance between the left back side guide pin 83 and the slide groove 78.

In the medium conveying apparatus 1 described above, since the width G2 is less than the width G1, a backlash in the conveyance direction at the front side of the second conveyance guide 34, the front side being close to the upper image sensor 62, is smaller than a backlash in the conveyance direction at the back side of the second conveyance guide 34, the back side being far from the upper image sensor 62. In this medium conveying apparatus 1, since the backlash at the front side of the second conveyance guide 34, the front side being close to the upper image sensor 62, is small, the upper image sensor 62 is able to be lifted appropriately.

In the medium conveying apparatus 1 according to the embodiment, the width G2 is less than the width G1, but the width G2 may be greater than the width G1. In the medium conveying apparatus 1, even if the width G2 is larger than the width G1, the second conveyance guide 34 is able to be lifted and lowered, and the diameter of the pinch roller 43 is able to be decreased by the pinch roller 43 being lifted in association with the lift of the second conveyance guide 34.

The above described medium conveying apparatus 1 is used as an image reading apparatus, but may be used as another apparatus. Examples of such an apparatus include a printer. When the medium conveying apparatus 1 is used as a printer, the reader 32 is substituted by a printing device. Even if the medium conveying apparatus 1 is used as an apparatus that is not an image reading apparatus, the medium conveying apparatus 1 is able to be downsized, by the pinch roller 43 being lifted in association with the lift of the second conveyance guide 34.

The disclosed medium conveying apparatus enables downsizing.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveying apparatus, comprising:

a conveyance guide that is supported by a frame so as to be able to be lifted and lowered, and guides a medium to a conveyance path by sliding along one surface of the medium;

a conveyance roller that is rotatably supported by the frame, and conveys the medium by coming into contact with an other surface of the medium, the other surface being on a reverse side of the one surface;

a pinch roller that is supported by the frame so as to be able to be lifted and lowered, and presses the medium against the conveyance roller by coming into contact with the one surface of the medium; and a reading unit that is supported by the frame so as to be able to be lifted and lowered, and reads an image of the one surface of the medium, wherein the conveyance guide lifts or lowers the pinch roller relatively to the frame by being lifted or lowered relatively to the frame, and lifts or lowers the reading unit relatively to the frame by being lifted or lowered relatively to the frame.

2. The medium conveying apparatus according to claim 1, wherein the conveyance guide lifts or lowers the pinch roller relatively to the frame, such that a distance from a center of rotation of the pinch roller to a plane that is along the one surface of the medium becomes larger than a length that is ⅙ of a diameter of the pinch roller.

3. The medium conveying apparatus according to claim 1, further comprising:

an engagement portion that is fixed to the conveyance guide, wherein the reading unit is lifted or lowered relatively to the frame, by the engagement portion being engaged with the reading unit; and the engagement portion is formed, such that the engagement portion is not in contact with the reading unit when the medium is not in contact with the conveyance guide.

4. The medium conveying apparatus according to claim 1, wherein the reading unit is arranged above a plane that is along a sliding surface that slides along the medium, the sliding surface being that of the conveyance guide.

5. The medium conveying apparatus according to claim 1, wherein the reading unit has an opposed surface that is opposed to the medium, and a portion that is adjacent to the opposed surface at a side of the conveyance guide, and the portion is formed so that a distance from a first point of the portion to a conveyance plane along a sliding surface of the conveyance guide that slides along the medium is greater than a distance from a second point of the portion that is closer to the opposed surface than the first point to the conveyance plane.

6. The medium conveying apparatus according to claim 1, further comprising:

a first pin that is fixed to the frame;

a second pin that is fixed to the frame so as to be arranged at a position more away from the reading unit than the first pin is;

a first supporting member that is fixed to the conveyance guide, and has a first slide groove formed therein, the first slide groove being where the first pin is fitted in; and a second supporting member that is fixed to the conveyance guide, and has a second slide groove formed therein, the second slide groove being where the second pin is fitted in, wherein the conveyance guide is supported by the frame so as to be able to be lifted and lowered, by the first pin moving along the first slide groove and the second pin moving along the second slide groove, and a clearance between the first pin and the first slide groove is smaller than a clearance between the second pin and the second slide groove.

7. A medium conveying apparatus, comprising:

a conveyance guide that is supported by a frame so as to be able to be lifted and lowered, and guides a medium to a conveyance path by sliding along one surface of the medium;

a conveyance roller that is rotatably supported by the frame, and conveys the medium by coming into contact with an other surface of the medium, the other surface being on the reverse side of the one surface; and a pinch roller that is supported by the frame so as to be able to be lifted and lowered, and presses the medium against the conveyance roller by coming into contact with the one surface of the medium, wherein the conveyance guide, when in contact with the medium which is not in contact with the pinch roller, is configured to be lifted relative to the frame in order to be placed at a height corresponding to a thickness of the medium, and when lifted higher than a predetermined height relative to the frame and in contact with a pinch roller shaft rotatably supporting the pinch roller, is configured to lift the pinch roller relatively to the frame.

* * * * *